United States Patent [19]

Nagase et al.

[11] Patent Number: 4,783,716

[45] Date of Patent: Nov. 8, 1988

[54] CHARGING OR DISCHARGING DEVICE

[75] Inventors: Yukio Nagase, Tokyo; Hiroshi Satomura, Hatogaya; Hidemi Egami, Zama; Yoshihiko Hirose, Yokohama, all of Japan

[73] Assignee: Canon Kabushiki Kaisha, Tokyo, Japan

[21] Appl. No.: 8,382

[22] Filed: Jan. 29, 1987

[30] Foreign Application Priority Data

| | | | |
|---|---|---|---|
| Jan. 30, 1986 | [JP] | Japan | 61-18954 |
| Jul. 15, 1986 | [JP] | Japan | 61-164573 |
| Nov. 25, 1986 | [JP] | Japan | 61-278808 |
| Nov. 28, 1986 | [JP] | Japan | 61-283467 |
| Nov. 28, 1986 | [JP] | Japan | 61-283468 |
| Nov. 28, 1986 | [JP] | Japan | 61-283469 |

[51] Int. Cl.[4] ..... G03G 15/02; H01T 19/00

[52] U.S. Cl. ..... 361/225; 361/230; 361/235; 355/3 CH; 250/326

[58] Field of Search ..... 361/225, 230, 235; 355/3 CH; 346/159; 250/324–326

[56] References Cited

U.S. PATENT DOCUMENTS

| | | | |
|---|---|---|---|
| 4,408,214 | 10/1983 | Fotland et al. | 346/159 |
| 4,626,876 | 12/1986 | Miyagawa et al. | 346/159 X |
| 4,652,318 | 3/1987 | Masuda et al. | 250/324 X |

FOREIGN PATENT DOCUMENTS

| | | | |
|---|---|---|---|
| 108559 | 6/1983 | Japan . | |
| 157183 | 8/1985 | Japan . | |
| 195563 | 10/1985 | Japan | 355/3 CH |
| 195566 | 10/1985 | Japan | 355/3 CH |

*Primary Examiner*—L. T. Hix
*Assistant Examiner*—D. Rutledge
*Attorney, Agent, or Firm*—Fitzpatrick, Cella, Harper & Scinto

[57] ABSTRACT

A device for electrically discharging or charging a member to be discharged or charged, includes a dielectric member, first and second electrodes embedded in the dielectric member, the first and second electrodes being supplied with an alternating voltage therebetween to cause discharge adjacent a part of a surface of the dielectric member at a predetermined discharge starting voltage, a third electrode disposed to or adjacent a part of the surface of the dielectric member at such a position as when the discharge occurs by application of the alternating voltage between the first and second electrodes, no discharge occurs between the first electrode and the third electrode or between the second electrode and the third electrode, AC source for applying an alternating voltage between the first electrode and the second electrode, DC source for applying a bias voltage between the third electrode and the member to be discharged or charged.

22 Claims, 16 Drawing Sheets

CHARGING OR DISCHARGING DEVICE

FIELD OF THE INVENTION AND RELATED ART

The present invention relates to a device for electrically discharging a member to be discharged or for electrically charging a member to be charged, more particularly to a device for charging or discharging an image bearing member in an image forming apparatus such as an electrophotographic copying apparatus and an electrostatic recording apparatus.

In the field of an eletrophotographic apparatus using an electrophotographic process, such as an electrophotographic copying machine, a laser beam printer and LED (light emitting diode) printer, and in the field of electrostatic recording apparatus using an electrostatic recording system, such as a facsimile machine and electrostatic printer, an image bearing member, such as a photosensitive member or an insulating member, is electrically charged or discharged. For this purpose, a corona discharging device has been widely used, which comprises a wire having a diameter of several tens microns which is supplied with a high voltage, e.g., several KV so as to produce corona discharging.

However, the corona discharging device involves a drawback that the discharge distribution becomes non-uniform even by a slight contamination of the wire, and the non-uniformness results in nonuniformly discharging or charging the member to be discharged or the member to be discharged. Additionally, it is required that the wire is spaced from a conductive shield by a certain or more distance, and therefore, there is a limit in reducing the size of the device. Also, the on-set voltage for starting the corona discharging is relatively high, thus necessiating a bulky power source.

As another type of discharging or charging device, it has been proposed that in U.S. Pat. No. 4,155,093, for example, that an alternating voltage is applied between electrodes sandwiching a dielectric member to produce electric discharge in an air gap between a lateral side surface of one of the electrodes and the adjacent surface of the dielectric member, so that positive and negative ions are produced; and the ions having a predetermined polarity is extracted to and deposited onto the member to be discharged or the member to be charged by an electric field formed by a DC bias voltage applied between said one of the electrodes and the member to be charged or discharged. In this device, the application of the AC voltage produces so active discharge that said one of the electrodes functioning as a discharging electrode is not easily contaminated, with the additional advantage of the relatively lower voltage applied than in the conventional corona discharging device and the advantage of the smallness of the device.

However, said one of the electrodes in the neighborhood of which the discharge occurs, is exposed in the air. Since a strong discharge action takes place particularly adjacent to the lateral side of this electrode, electrode is easily colloded or damaged by plasma etching or oxidization caused by the discharging. When the damage is produced in the electrode, the non-uniform discharging results, so that the discharging or charging action becomes non-uniform. Because of these, there still is a practical problem in the durability.

Further, another type of discharging and charging devices are known, as disclosed in Japanese Laid-Open Patent Applications Nos. 108559/1983 and 157183/1985, wherein a plurality of electrodes are embedded in a body of a dielectric member, and between the electrodes, an alternating voltage is applied to produce a discharge adjacent a surface of the dielectric member.

In the device disclosed in the former Japanese Publication, all of the electrodes are entirely embedded in the dielectric member. Therefore, with use, the surface of the dielectric member is charged up to the polarity opposite to that of the charging ions. As a result, the DC electric field formed between the electrode in the dielectric member and the ground is reduced, and therefore, it is considered that the desired charging current can not be provided. In any event, the charging efficiency is significantly low.

In the device disclosed in the latter Japanese publication two electrodes are embedded in a dielectric member, and one electrode is mounted to a surface of the dielectric member, bridging the two electrodes in the dielectric member. However, the discharging principle of this device is essentially the same as that of the above-described U.S. Pat. No. 4,155,093 because the discharge occurs in the air gap between the lateral surface of the outside electrode and that portion of the dielectric member surface as is opposed to the two electrodes in the dielectric member. Therefore, this device remains involving the problem of the damage or collosion of the lateral surface of the electrode.

SUMMARY OF THE INVENTION

Accordingly, it is a principal object of the present invention to provide a discharging or charging device capable of uniformly charging or discharging a member, which comprises at least two electrodes in a dielectric member, wherein an alternating voltage is applied between the electrodes, and wherein a desired polarity of the ions can be efficiently extracted with less collosion or damage to the electrode and with the high durability.

It is another object of the present invention to provide a charging or discharging device which is not influenced by the change in the ambient conditions such as the relative humidity, and therefore the discharging distribution is always uniform with stability.

It is a further object of the present invention to provide a charging or discharging device wherein the durability of a dielectric member in which the electrodes are embedded is high.

It is a further object of the present invention to provide a stably operable charging or discharging device which is not easily contaminated and which is small in size and operable by a relatively low voltage.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
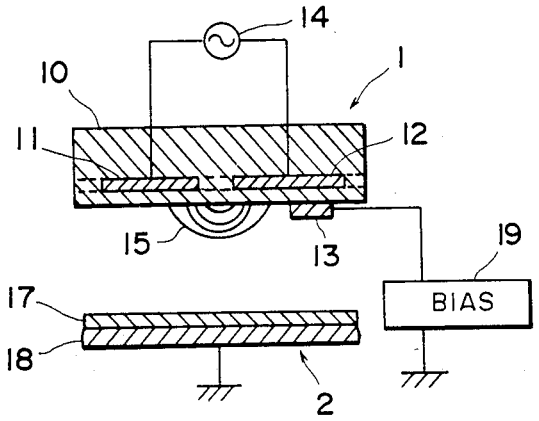
FIG. 1 is a sectional view of a device according to an embodiment of the present invention.

Referring to FIG. 1, there is shown a discharging device according to an embodiment of the present invention.

The discharging device 1 includes a dielectric member 10, at least two electrodes 11 and 12 embedded in the dielectric member 10 and an exposed electrode 13 which is exposed in the air. The discharging device 1 electrically discharge or charge a member 2 to be discharged or charged, which includes an insulating or photoconductive layer 17 and a conductive layer 18 which functions as a back electrode. In this embodiment, the member 2 is movable relative to the charging device 1. The charging device 1 is usable for electrically discharging the member 2 or charging it. However, the following description will be made as to the case of charging the member only, for the sake of simplicity of explanation.

In this Specification, "charging" means that ions of a predetermined polarity are applied to a member to be charged and are deposited thereon, while "discharging" means that ions of a predetermined polarity is removed from a member to be discharged which has been charged, so that the charge is erased.

Each of the above described components of the discharging device 1 according to this embodiment, will be described.

The dielectric member 10 is of a solid inorganic dielectric material having durability to discharge, such as glass, ceramic, oxide, e.g., $SiO_2$, MgO and $Al_2O_3$, nitride, e.g., $Si_3N_4$, AlN. The dielectric member 10 is an elongated member having a substantially rectangular cross section. Each of the electrodes 11, 12 and 13 extends along the length of the dielectric member 10. The embedded electrodes 11 and 12 are arranged substantially parallel to each other in the dielectric member 10. The embedded electrodes 11 and 12 are also parallel to the bottom surface, as seen in FIG. 1, of the dielectric member 10 (the surface opposed to the member to be charged 2) and are spaced from the bottom surface by the same distance. This arrangement is not innevitable, but preferable from the standpoint of easy manufacturing. The material of the electrodes is Al, Cr, Au, Ni or the like, for example. It should be noted that those electrodes are embedded in the dielectric member 10 and is not exposed to the air. Therefore, it is protected from collosion or damage, and this is why the above mentioned materials are usable without decreasing the high durability.

The distance between the embedded electrodes is preferably not less than 1 micron, more preferably 3 –200 microns in consideration of the dielectric strength.

The embedded electrodes 11 and 12 are disposed at such a position, respectively, that when an alternating voltage is applied therebetween, a discharge occurs adjacent a part of the surface of the dielectric member 10 at a predetermined on-set voltage (discharge starting voltage). That is, when an alternating voltage not less than the on-set voltage is applied by an alternating power source 14 between the embedded electrodes 11 and 12, a discharge occurs, positive and negative ions are alternately produced, in a single region indicated by a reference numeral 15. The center of the region is substantially at a portion of the bottom surface of the dielectric member 10 (the surface substantially parallel to a line connecting the electrodes 11 and 12 to which the alternating voltage is applied) that is opposed to a portion between the electrodes. The on-set voltage is dependent on the distance between the embedded electrodes 11 and 12, the thickness of the dielectric member below the embedded electrodes, a dielectric constant of the dielectric member and the like, and it is suitably determined by one skilled in the art.

The exposed electrode 13 is fixed to the surface of the dielectric member 10 where the discharge occurs by the application of the alternating voltage. The material of the electrode 13 is conductive metal having high anti-collosion and anti-oxidation properties, for example, a high fusing point metal such as Ti, W, Cr, Te, Mo, Fe, Co, Ni, Au and Pt or an alloy containing one or more of those metals, or an oxide thereof. The thickness of the exposed electrode 13 is 0.1–100 microns, preferably 0.2–20 microns, and the width thereof is not less than 1 micron, preferably 10 –500 microns. The position of the exposed electrode 13 is adjacent to the discharge occurrence region 15, and the position is such that an alternating voltage which initiates the discharge in cooperation with any one of the embedded electrodes 11 and 13 is higher than the above described on-set voltage. More particularly, when the voltage applied between the embedded electrodes 11 and 12 is increased from below the on-set voltage, the discharge starts in the region 15 at the on-set voltage, but no discharge occurs between any one of the embedded electrodes 11 and 12 and the exposed electrode 13. The exposed electrode 13 is disposed at such a position. Here, "adjacent the discharge region" includes the inside and outside thereof. The outside is preferable, but the inside is possible if it is near the edge of the discharge region with the advantages of the present invention.

In this embodiment, the dielectric member 10 is of one integral member. However, it may be formed as two layers of dielectric material which are bonded at the broken line which is flush with the top and/or bottom surface of the embedded electrodes 11 and 12. In this case, the materials of the respective layers may be the same or different. Particularly when the dielectric member is of the two layered structure, that one of the layers exposed to the discharge region is of inorganic material or the like which exhibits a high durability to the discharge so as to assure the life of the dielectric material, while the other layer may be of organic dielectric material. In either cases (one layer or two layer), the thickness of the dielectric member below the embedded electrodes 11 and 12 is preferably not less than 1 micron and not more than 500 microns, particularly preferably, not less than 3 microns and not more than 200 microns. The details of the multi-layer structure of the dielectric member will be described hereinafter.

Description will be made as to the relation among the applied alternating voltage starting discharge between the embedded electrodes 11 and 12, the applied alternating voltage starting the discharge between the embedded electrode 11 and the exposed electrode 13 and the applied alternating voltage starting the discharge between the embedded electrode 12 and the exposed electrode 13, in connection with the impedances of the respective electric circuits in the discharging device 1 of this embodiment.

Figure 2:
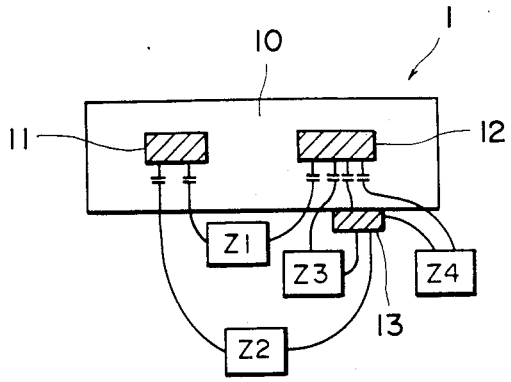
FIG. 2 shows an electric equivalent circuit of the device shown in FIG. 1.

FIG. 2 illustrates an electric equivalent circuit to the discharging device shown in FIG. 1, wherein Z1 is an impedance corresponding to the electrostatic capacity of the air existing between the embedded electrodes 11 and 12 in the discharging path therebetween, Z2 is an impedance corresponding to an electrostatic capacity of the air existing between the embedded electrode 11 and the exposed electrode 13 in the discharging path therebetween; Z3 and Z4 are impedances corresponding to electrostatic capacities of the air existing between the embedded electrode 11 and the exposed electrode 13 in the discharge path therebetween and between the embedded electrode 12 and the exposed electrode 13 in the discharge path therebetween, respectively. As understood, there are four possible discharge paths, a Z1 loop containing the impedance Z1, a Z2 loop containing the impedance Z2, (Z2+Z3) loop containing the impedances Z2 and Z3 and (Z2+Z4) loop containing the impedances Z2 and Z4. In this equivalent circuit, if $Z1<Z2$, $Z1<Z2+Z3$ and $Z1<Z2+Z4$ are satisfied, the voltage which is applied between the embedded electrodes 11 and 12 and which starts the discharge in the respective discharge paths satisfy:

$$V1<V2,\ V3,\ V4$$

where

V1 is an applied alternating voltage between the embedded electrodes 11 and 12 which starts the discharge in the Z1 loop;

V2 is an applied alternating voltage between the embedded electrodes 11 and 12 which starts the discharge in the Z2 loop;

V3 is an applied alternating voltage between the embedded electrodes 11 and 12 which starts the discharge in the (Z2+Z3) loop;

V4 is an applied alternating voltage between the embedded electrodes 11 and 12 which starts the discharge in the (Z2+Z4) loop.

In FIG. 1 embodiment, the above described relations in the discharge starting voltages are realized by providing the exposed electrode 13 only adjacent to one of the embedded electrodes, for example, the embedded electrode 12 and by disposing an inside lateral surface of the exposed electrode 13 outside that lateral end of the embedded electrode 12 which is opposed to the embedded electrode 11.

Now, the description will be made with respect to the operation of the discharging device 1 of this embodiment.

First, the exposed electrode 13 of the discharging device 1 is placed opposed to the insulating or photoconductive layer 17 of the member 2 to be charged. Then, an alternating voltage which is not less than the discharge starting voltage is applied by the alternating voltage source 14 between the embedded electrodes 11 and 12, while a DC bias voltage is applied by the DC bias voltage source 19 between the exposed electrode 13 and the conductive layer of the member 2 to be charged. The alternating voltage has 0.5–6 KVpp (peak-to-peak), preferably 1–∝KVpp, while the DC bias voltage is 0.2–4 KV, preferably 0.5 –2 KV. Here, it should be noted that an electric insulation of DC current is established between an AC circuit constituted by the alternating voltage source 14, the dielectric member 10, the embedded electrode 11 and the embedded electrode 12 and a DC electric circuit constituted by the DC bias voltage source 19, the exposed electrode 13 and the conductive layer 18.

By the application of the alternating voltage from the alternating voltage source 14, the electric discharge occurs in the discharge region 15, whereby positive and negative ions are produced there.

For the purpose of better understanding the present invention, an explanation will be made with respect to the case where there is no exposed electrode 13. When the alternating voltage is applied between the embedded electrode 11 and 12 without the exposed electrode 13, the ions are produced in the discharge region 15. However, the produced ions are bound by the strong electric field formed between the embedded electrodes 11 and 12, so that the ions are produced and disappeared repeatedly in accordance with the phase change of the alternating voltage, and it is not possible to move the ions to the member 2 to be charged. In an attempt to extract the produced ions, it would be considered that a DC bias voltage is applied between the embedded electrode 12 and the conductive layer 18 of the member 2 to be charged. If it is possible by this method to extract the produced ions of the desired polarity toward the member 2 to be charged, it is preferable from the standpoint of the durability because it is not necessary to use any exposed electrode. However, the inventors have found and confirmed that with this structure, it is not possible to move the produced ions toward the insulating or photoconductive layer of the member 2 to be charged.

The reason for this is considered as being as follows. For example, it is assumed that a positive voltage is applied to the embedded electrode 12 relative to the conductive layer 18 in an attempt to move the positive ions to the member 2. Then, the positive potential applied to the embedded electrode 12 retains negative ions on the bottom surface of the dielectric member 10. The negative ions accumulated there in this manner function to weaken the electric field between the embedded electrode 12 and the member 2 to be charged, necessarily resulting in weakening the effect expected by the application of the positive voltage.

Therefore, even if the bias voltage is applied between the embedded electrode 12 and the conductive layer 18, the ions are not extracted toward the member 2 due to the weakening of the electric field.

The applied alternating voltage between the embedded electrodes 11 and 12 at the time when the discharge starts between the exposed electrode 13 and the embedded electrode 11 and between the exposed electrode 13 and the embedded electrode 12, is higher than the applied alternating voltage between the embedded electrodes 11 and 12 at the time when the discharge starts adjacent the dielectric member between the embedded electrodes 11 and 12. Therefore, when the discharge starts by the application of the alternating voltage between the embedded electrode 11 and the embedded electrode 12, no discharge occurs adjacent the surface of the exposed electrode 13 by the application of the alternating voltage only by the alternating source 14. However, even in the region outside the discharge region 15, the exposed electrode 13 is placed in the state under which the discharge easily occurs in the neighborhood of the discharge region 15, by the influence by the alternating electric field by the alternating voltage source 14. This state is stimulated by the application of the bias voltage between the exposed electrode and the conductive layer 18 by the DC bias source 19, and therefore, a discharge occurs in the neighborhood of the exposed electrode 13 so that positive and negative ions are produced. This discharge is relatively weak as compared with the discharge in the discharge region 15. Here, the weakness of the discharge can be discriminated if the luminous phenomenon is observed by naked eyes. More particularly, the observation is made when the power is supplied to the DC bias voltage source and when the power supply thereto is stopped. Because of the weakness of the discharge in the neighborhood of the exposed electrode 13, the surface of the exposed electrode 13 is not deteriorated by plasma etching or oxidation which otherwise caused by discharge action. Therefore, the durability of the discharge device of this embodiment is high. If the exposed electrode 13 is so disposed that its inside lateral surface is adjacent to the lateral end of the discharge region 15 and inside thereof, the discharge occurs also in the neighborhood of the surface of the exposed electrode 13 by the alternating voltage applied between the embedded electrodes 11 and 12. However, the alternating voltage to be applied between the embedded electrodes 11 and 12 to start this discharge is higher than the alternating voltage therebetween for starting the discharge between the embedded electrodes 11 and 12, and therefore, the strong discharge is concentrated to the surface of the dielectric member between the embedded electrodes 11 and 12, and for this reason, the deterioration of the exposed electrode 13 is significantly small as compared with the conventional discharger.

In this embodiment, it is preferable that the position of the exposed electrode 13 is not distant very much from the positions of the embedded electrodes 11 and 12, in other words, that it is not outside the influence by the alternating field. More particularly, it is preferable that the exposed electrode 13 is placed at such a position that $V_{off} > V_{on}$ is satisfied, where $V_{off}$ is a bias voltage which starts a discharge in the neighborhood of the exposed electrode 13 without application of the alternating voltage between the embedded electrodes, and $V_{on}$ is a bias voltage which starts the discharge in the neighborhood of the exposed electrode 13 with the alternating voltage applied between the embedded electrodes.

On the other hand, the ions produced in the neighborhood of the exposed electrode 13 are extracted toward the member 2 to be charged by the electric field formed by the bias voltage applied between the exposed electrode 13 and the member 2 to be charged by the DC bias voltage source 19, and they are deposited on the insulating or photoconductive layer 12 surface of the member 2, thus charging the member 2 to the polarity of the extracted ions. In the discharging action, the ions produced in the strong discharge regions 15 by the application of the alternating voltage between the embedded electrodes 11 and 12 is hardly utilized for the charging of the member 2, and the ions used for charging the member 2 are mainly in the ions produced by the relatively weak discharge adjacent to the exposed electrode 13. From this standpoint, the discharge by the alternating voltage functions rather "cue" for the production of ions usable to charge or discharge the member 2, than as directly charging or discharging the member 2.

To confirm the effects of the present invention, the comparison has been made between a discharging device employing the exposed electrode disclosed in U.S. Pat. No. 4,155,093 and the discharger of this embodiment, which have been manufactured by the same materials, more particularly, the dielectric member is of $SiO_2$, and the exposed electrode is of Ti, under the conditions that the same charging current is provided, that is, the same charging effect is provided. The thickness of the dielectric member between the electrode and the other electrode was 200 microns in the conventional device, and 10 microns in our device. The alternating voltage was 3 KVpp, 30 KHz in the conventional device, and 1.7 KVpp, 30 KHz in the device of this embodiment. When these were actually operated, the remarkable deterioration was observed in approximately 10–15 hours of the continuous operation in the conventional device, which resulted in non-uniform charging of the member. On the contrary, in the device of the embodiment of this invention, hardly any deterioration of the exposed electrode 13 was observed in 300 hours of the continuous operation. There was no non-uniform charging. Even in the case where the inside lateral surface of the exposed electrode 13 was in the neighborhood of and inside the discharge area, the non-uniform discharge was not observed in 300 hours of the continuous operation, and only a slight color change was observed on the surface of the exposed electrode 13 without any remarkable deterioration.

Figure 3:
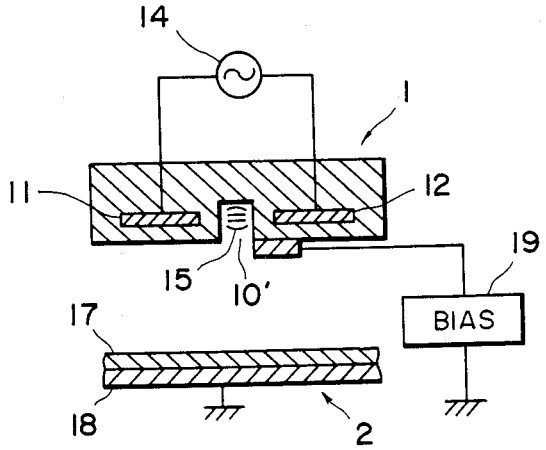
FIG. 3 is a sectional view of a device according to another embodiment of the present invention.

FIG. 3 illustrates another embodiment of the present invention. Since this embodiment is similar to the previous embodiment with the exception of the points described hereinafter, the detailed description has been omitted by assigning the same reference numerals to the corresponding elements. The discharging device of this embodiment has a bottom surface partly cut away in the middle of the dielectric member to form a recess or opening 10'. It should be noted, however, that the embedded electrode 11 and the embedded electrode 12 are not exposed to the air, but they are embedded in the dielectric member 10. Adjacent the edge of the recess 10', there is fixed the exposed electrode 13. When an alternating voltage is applied between the embedded electrodes by the alternating voltage source 14, the discharge occurs in the region indicated by a reference numeral 15 in FIG. 3, whereby positive and negative ions are produced. Under the influence of the electric field formed by the alternating voltage, a relatively weak discharge occurs in the neighborhood of the exposed electrode 13, so that ions are produced, which are in turn extracted to the insulating or photoconductive layer 17 of the member 2 to be charged, by the bias electric field formed between the exposed electrode 13 and the conductive layer 18. In this embodiment, &he relation among the discharge starting voltages in the respective discharge path is satisfied. However, contrary to the case of FIG. 1, the inside lateral surface of the exposed electrode 13 is disposed at such a position as corresponds to between the inside lateral surfaces of the embedded electrodes 11 and 12. The present invention can be embodied in this manner.

Figure 4:
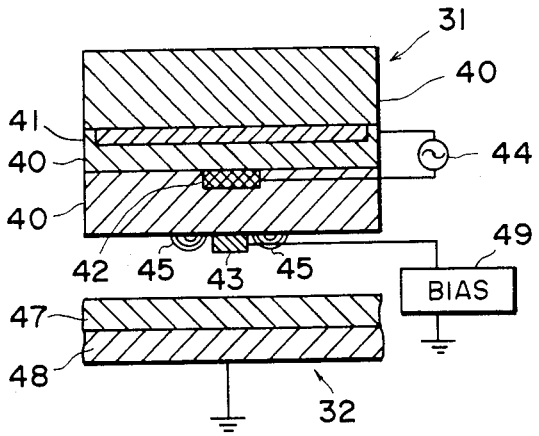
FIG. 4 is a sectional view of a device according to a further embodiment of the present invention.

FIG. 4 illustrates a further embodiment of the present invention. In this embodiment, the discharging device 31 comprises a dielectric member 40, at least two embedded electrodes 41 and 42 and exposed electrode 43. By the discharging device 31, a member 32 to be charged or discharged is electrically charged or discharged. The member 32 comprises an insulating or photoconductive layer 47 and a conductive layer 48 functioning as a back electrode. A relative movement is caused between the discharging device 31 and the member 32. Similarly to the embodiments described in the foregoing, the discharging device of this embodiment is usable to electrically discharge or charge the member 32, but the following descriptions will be made with respect to the case where it is electrically charged.

The dielectric member 40 is of inorganic solid dielectric member durable to discharge, for example an oxide such as glass, ceramic, $SiO_2$, MgO and $Al_2O_3$ or a nitride such as SiN and AlN. In this embodiment, the dielectric member 40 is an elongated member having a rectangular cross section. The electrodes 41, 42 and 43 extend along the length of the dielectric member 40. In this embodiment, two electrodes 41 and 42 are embedded in the dielectric member 40 and extend substantially parallel to each other. The embedded electrodes 41 and 42 are parallel &o the bottom surface of the dielectric member 40 as seen in FIG. 4 (the surface opposed to the member 32) and are distant from the bottom surface by different distances. This is not innevitable but preferable from the stand point of easy manufacturing. As for the material of those electrodes, there are Al, Cr, Au or Ni. It should be noted that, in this embodiment, too, that the electrodes are not exposed in the portion contributable to the discharging action, and therefore, no collosion occurs there. For this reason, the high durability can be provided even if the above mentioned materials are used. It is preferable that the distance between the embedded electrodes is not less than 1 micron, preferably, 3–200 microns in consideration of the durability of insulation.

The embedded electrodes 41 and 42 are disposed at such a position when the voltage applied between the embedded electrodes 41 and 42 is increased, a discharge occurs adjacent to a part of the surface of the dielectric member 40 at a predetermined discharge starting voltage (on-set voltage). More particularly, when an alternating voltage not less than the predetermined discharge starting voltage is applied by the alternating voltage source 14 between the embedded electrodes 41 and 42, strong discharges occur in the two regions designated by reference numeral 45 which is regions corresponding to lateral surfaces of the embedded electrode 42 closer to the bottom surface (the surface substantially normal to a line connecting the electrodes 41 and 42 to which the alternating voltage is applied) and adjacent to the bottom surface of the dielectric member 40. By this, positive and negative ions are alternately produced. The discharge starting voltage is dependent on the distance between the embedded electrodes 41 and 42, the thickness of the dielectric member below the embedded electrodes and the dielectric constant of the dielectric member, and one skilled in the art determines properly.

The exposed electrode 43, in this embodiment, is fixed to the bottom surface of the dielectric member 40, that is, to the surface the discharge occurs by the application of the alternating voltage. As for the material of the electrode 43, use can be made with a conductive metal having high durability to collosion and oxidation, for example, a high fusing point metal such as Ti, W, Cr, Tz, Mo, Fe, Co, Ni, Au and Pt or an alloy containing one or more of those metals or an oxide thereof. The thickness thereof is 0.1–100 microns, preferably 0.2–200 microns. The width thereof is not less than 1 micron, preferably 10–500 microns, and it is less than the width of the embedded electrode 42. The exposed electrode 43 is disposed adjacent the center between the discharge regions 45 and at such a position that the discharge starting voltages between itself and the embedded electrode 41 and between itself and the embedded electrode 42 are both higher than the above described predetermined discharge starting voltage. More particularly, when the discharge starts in said regions 45 by the application of the alternating voltage between the embedded electrodes 41 and 42, no electric discharge occurs between the exposed electrode 43 and the embedded electrode 11 or between the exposed electrode 43 and the embedded electrode 12. The exposed electrode 43 is disposed adjacent to the discharge regions 45. Here, "adjacent to the discharge regions", includes the inside or outside thereof, the outside is preferable, but the inside is possible if it is adjacent to the edge of the discharge region.

Description will be made as to the relation among the applied alternating voltage starting discharge between the embedded electrodes 41 and 42, the applied alternating voltage starting the discharge between the embedded electrode 41 and the exposed electrode 43 and the applied alternating voltage starting the discharge between the embedded electrode 42 and the exposed electrode 43, in connection with the impedances of the respective electric circuits in the discharging device 31 of this embodiment.

Figure 5:
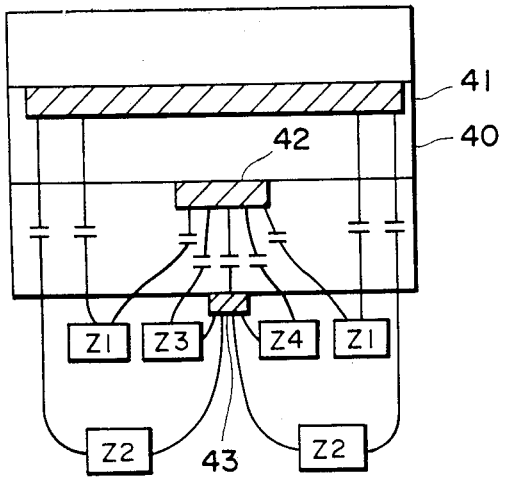
FIG. 5 shows an electrical equivalent circuit of the device of FIG. 4.

FIG. 5 illustrates an electric equivalent circuit to the discharging device shown in FIG. 4, wherein Z1 is an impedance corresponding to the electrostatic capacity of the air existing between the embedded electrodes 41 and 42 in the discharging path therebetween; Z2 is an impedance corresponding to an electrostatic capacity of the air existing between the embedded electrode 41 and the exposed electrode 43 in the discharging path therebetween; Z3 and Z4 are impedances corresponding to electrostatic capacities of the air existing between the embedded electrode 41 and the exposed electrode 43 in the discharge path therebetween and between the embedded electrode 42 and the exposed electrode 43 in the discharge path therebetween, respectively. As understood, there are four possible discharge paths, a Z1 loop containing the impedance Z1, a Z2 loop containing the impedance Z2, (Z2+Z3) loop containing the impedances Z2 and Z3 and (Z2+Z4) loop containing the impedances Z2 and Z4. In this equivalent circuit, if $Z1<Z2$, $Z1<Z2+Z3$ and $Z1<Z2+Z4$ are satisfied, the voltage which is applied between the embedded electrodes 41 and 42 and which starts the discharge in the respective discharge paths satisfy:

$$V1<V2, V3, V4$$

where

V1 is an applied alternating voltage between the embedded electrodes 41 and 42 which starts the discharge in the Z1 loop;

V2 is an applied alternating voltage between the embedded electrodes 41 and 42 which starts the discharge in the Z2 loop;

V3 is an applied alternating voltage between the embedded electrodes 41 and 42 which starts the discharge in the (Z2+Z3) loop;

V4 is an applied alternating voltage between the embedded electrodes 41 and 42 which starts the discharge in the (Z2+Z4) loop.

In FIG. 4 embodiment, the above described relations in the discharge starting voltages are realized by providing the exposed electrode 43 adjacent to the center of one 42 of the embedded electrodes. However, the position may be changed under the condition that the above requirements are satisfied.

Now, the description will be made with respect to the operation of the discharging device 1 of this embodiment.

First, the exposed electrode 43 of the discharging device 31 is placed opposed to the insulating or photoconductive layer 47 of the member 32 to be charged. Then, an alternating voltage which is not less than the discharge starting voltage is applied by the alternating voltage source 44 between the embedded electrodes 41 and 42, while a bias voltage is applied by the bias voltage source 49 between the exposed electrode 43 and the conductive layer of the member 32 to be charged. The alternating voltage has 0.5–6 KVpp (peak-to-peak), preferably 1–4 KVpp, while the DC bias voltage is 0.2–4 KV, preferably 0.5 –2 KV. Here, it should be noted that an electric insulation of DC current is established between an AC circuit constituted by the alternating voltage source 44, the dielectric member 40, the embedded electrode 41 and the embedded electrode 42 and a DC electric circuit constituted by the DC bias voltage source 49, the exposed electrode 43 and the conductive layer 48.

By the application of the alternating voltage from the alternating voltage source 44, the electric discharge occurs in the discharge region 45, whereby positive and negative ions are produced there.

For the purpose of better understanding the present invention, an explanation will be made with respect to the case where there is no exposed electrode 43. When the alternating voltage is applied between the embedded electrode 41 and 42 without the exposed electrode 43, the ions are produced in the discharge region 45. However, the produced ions are bound by the strong electric field formed between the embedded electrodes 41 and 42, so that the ions are produced and disappeared repeatedly in accordance with the phase change of the alternating voltage, and it is not possible to move the ions to the member 32 to be charged. In an attempt to extract the produced ions, it would be considered that a DC bias voltage is applied between the embedded electrode 42 and the conductive layer 48 of the member 32 to be charged. If it is possible by this method to extract the produced ions of the desired polarity toward the member 32 to be charged, it is preferable from the standpoint of the durability because it is not necessary to use any exposed electrode. However, the inventors have found and confirmed that with this structure, it is not possible to move the produced ions toward the insulating or photoconductive layer of the member 32 to be charged.

The reason for this is considered as being as follows. For example, it is assumed that a positive voltage is applied to the embedded electrode 42 relative to the conductive layer 48 in an attempt to move the positive ions to the member 32. Then, the positive potential applied to the embedded electrode 42 retains negative ions on the bottom surface of the dielectric member 40. The negative ions accumulated there in this manner function to weaken the electric field between the embedded electrode 42 and the member 32 to be charged, necessarily resulting in weakening the effect expected by the application of the positive voltage.

Therefore, even if the bias voltage is applied between the embedded electrode 42 and the conductive layer 48, the ions are not extracted toward the member 32 due to the weakening of the electric field.

The applied alternating voltage between the embedded electrodes 41 and 42 at the time when the discharge starts between the exposed electrode 43 and the embedded electrode 41 and between the exposed electrode 43 and the embedded electrode 42, is higher than the applied alternating voltage between the embedded electrodes 41 and 42 at the time when the discharge starts adjacent the dielectric member between the embedded electrodes 41 and 42. Therefore, when the discharge starts by the application of the alternating voltage between the embedded electrode 41 and the embedded electrode 42, no discharge occurs adjacent the surface of the exposed electrode 43 by the application of the alternating voltage only by the alternating source 44. However, even in the region outside the discharge region 45, the exposed electrode 13 is placed in the state under which the discharge easily occurs in tne neighborhood of the discharge region 45, by the influence by the alternating electric field by the alternating voltage source 44. This state is stimulated by the application of the bias voltage between the exposed electrode and the conductive layer 48 by the DC bias source 49, and therefore, a discharge occurs in the neighborhood of the exposed electrode 43 so that positive and negative ions are produced. This discharge is relatively weak as compared with the discharge in the discharge region 45. Here, the weakness of the discharge can be discriminated if the luminous phenomenon is observed by naked eyes. More particularly, the observation is made when the power is supplied to the DC bias voltage source and when the power supply thereto is stopped. Because of the weakness of the discharge in the neighborhood of the exposed electrode 43, the surface of the exposed electrode 43 is not deteriorated by plasma etching or oxidation which otherwise caused by discharge action. Therefore, the durability of the discharge device of this embodiment is high. If the exposed electrode 43 is so disposed that its one or both lateral surfaces are adjacent to the lateral end of the discharge region 45 and inside thereof, the discharge occurs also in the neighborhood of the surface of the exposed electrode 43 by the alternating voltage applied between the embedded electrodes 41 and 42. However, the alternating voltage to be applied between the embedded electrodes 41 and 42 to start this discharge is higher than the alternating voltage therebetween for starting the discharge between the embedded electrodes 41 and 42, and therefore, the strong discharge is concentrated to the surface of the dielectric member between the embedded electrodes 41 and 42, and for this reason, the deterioration of the exposed electrode 43 is significantly small as compared with the conventional discharger.

In this embodiment, it is not innevitable that the exposed electrode is right below the center of the embedded electrode 42, but it is preferable that the position of the exposed electrode 43 is not distant very much from the positions of the embedded electrodes 41 and 42, in other words, that it is not outside the influence by the alternating field. More particularly, it is preferable that the exposed electrode 43 is placed at such a position that Voff>Von is satisfied, where Voff is a bias voltage which starts a discharge in the neighborhood of the exposed electrode 13 without application of the alternating voltage between the embedded electrodes, and Von is a bias voltage which starts the discharge in the neighborhood of the exposed electrode 43 with the alternating voltage applied between the embedded electrodes.

On the other hand, the ions produced in the neighborhood of the exposed electrode 43 are extracted toward the member 32 to be charged by the electric field formed by the bias voltage applied between the exposed electrode 43 and the member 32 to be charged by the DC bias voltage source 49, and they are deposited on the insulating or photoconductive layer 42 surface of the member 32, thus charging the member 32 to the polarity of the extracted ions. In the discharging action, the ions produced in the strong discharge regions 45 by the application of the alternating voltage between the embedded electrodes 41 and 42 is hardly utilized for the charging of the member 32, and the ions used for charging the member 32 are mainly in the ions produced by the relatively weak discharge adjacent to the exposed electrode 43. From this standpoint, the discharge by the alternating voltage functions rather "cue" for the production of ions usable to charge or discharge the member 32, than as directly charging or discharging the member 32.

In this embodiment, the dielectric member 40 has been described as one integral member, but this is not always necessary. As an alternative, to or three layers structure may be employed wherein plural dielectric members are joined between the dielectric member 40 and/or the top or bottom surface of the embedded electrode 41. In this case, the materials of the respective layers may be the same or different. When the two or three layer structure is used, the dielectric layer (the bottom most in the Figure) which is exposed to the discharge is made of an inorganic material having high durability to the discharge to assure the life of the dielectric member, while an organic dielectric member is used for the material of the other dielectric layer were layers. In any case, the integral structure, two or three layers structure, the thickness of the dielectric layer below the embedded electrodes is not less than 1 micron and not more than 500 microns, preferably not less than 3 microns and not more than 200 microns.

To confirm the effects of the present invention, the comparison has been made between a discharging device employing the exposed electrode disclosed in U.S. Pat. No. 4,155,093 and the discharger of this embodiment, which have been manufactured by the same materials, more particularly, the dielectric member is of $SiO_2$, and the exposed electrode is of Ti, under the conditions that the same charging current is provided, that is, the same charging effect is provided. The thickness of the dielectric member between the electrode and the other electrode was 200 microns in the conventional device, and 10 microns in our device. The alternating voltage was 3 KVpp, 30 KHz in the conventional device, and 1.3 KVpp, 30 KHz in the device of this embodiment. When these were actually operated, the remarkable deterioration was observed in approximately 10–15 hours of the continuous operation in the conventional device, which resulted in non-uniform charging of the member. On the contrary, in the device of the embodiment of this invention, any deterioration of the exposed electrode 43 was observed in 300 hours of the continuous operation. There was no non-uniform charging. Even in the case where the inside lateral surface of the exposed electrode 43 was in the neighborhood of and inside the discharge area, the nonuniform discharge was not observed in 300 hours of the continuous operation, and only a slight color change was observed on the surface of the exposed electrode 43 without any remarkable deterioration.

In this embodiment, the exposed electrode 43 is directly fixed to the bottom surface of the dielectric member 40, but this is not always necessary. As an alternative, it may be a stretched wire electrode disposed between the bottom surface and the surface of the insulating or photoconductive layer 47 and at such a position as satisfies the relationship among the discharge starting voltages described in conjunction with FIG. 5. The wire electrode may be fixed to the discharging device 31 adjacent its longitudinal ends, or may be supported on another member or members.

Figure 6:
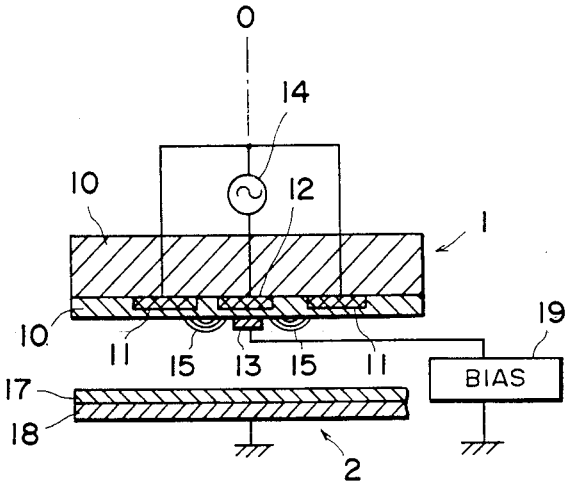
FIG. 6 is a sectional view of a device according to a further embodiment of the present invention.
Figure 7:
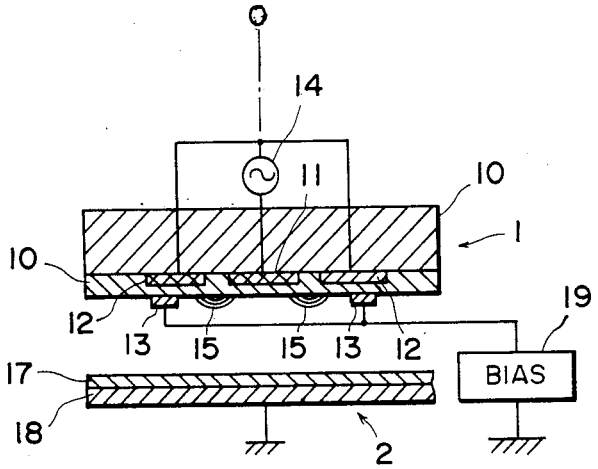
FIG. 7 is a sectional view of a further embodiment of the present invention.

FIGS. 6 and 7 illustrate other embodiments of the discharging device. The embodiment is essentially the same as FIG. 1 embodiment. This will be understood if a vertical center line O is drawn, and only one half is considered. Therefore, the detailed explanation is omitted for the sake of simplicity, by assigning the same reference numerals to the corresponding elements.

In any of the foregoing embodiments, the voltage applied to the embedded electrodes, is not limited to an ordinary alternating voltage having a sine wave curve, but a pulse wave form, a rectangular wave form or a triangular wave form are usable if an alternating electric field can be formed adjacent the exposed electrode.

The bias voltage applied between the exposed electrode and the member to be charged or discharged is not necessarily a DC bias voltage, but it may be an AC bias voltage. The alternating bias voltage application can be used when the member is discharged electrically. The above described advantageous effects can be provided even in this case. What is required for the bias voltage is that such an electric field is formed between the exposed electrode and the member to be charged or discharged, that the ions having a predetermined polarity among the positive and negative ions produced by the discharge, is moved to the member to be charged or discharged, and as a result, the member is discharged or charged to the predetermined polarity.

As described in the foregoing, according to the present invention, the embedded electrodes are covered by the dielectric member, so that the durability of the discharging device is significantly improved. Further although there is a possibility that it can not charge or discharge the member because of the charge-up of the dielectric member containing the electrodes, the provision of the exposed electrode and the bias voltage applied thereto make it possible to extract the ions. It should be noted that no strong discharge occurs adjacent to the exposed electrode, so that the durability of the exposed electrode is high, too. Thus, the discharging device can be provided which efficiently and stably discharge or charge a member.

A further improved embodiment will be described. The points of improvement are applicable to any of the discharging devices described in conjunction with FIGS. 1, 3, 4, 6 and 7. As a representative, the following description will be made with respect to the structure of FIG. 1 embodiment.

FIGS. 8, 9, 10 and 11 illustrate a first improved embodiment, wherein heating elements 20, 21, 22 and 23 are employed for heating the dielectric member 10 in the discharge device 1. According to the present invention described above, the durability to collosion of the electrode due to the discharge has been remarkably improved. However, on the other hand, there is another problem of wetness on the surface of the electrode or the dielectric member. When the discharge device is not used, the moisture contained in the ambient air is sometimes deposited on the surface of the dielectric member and/or the electrode. If this occurs, a problem arises that even if the power is supplied to the discharger, the discharge does not occur as long as the moisture on the surface of the electrode and the surface of the dielectric member are removed. For this reason, when the moisture of the ambient air is high, or when the device is bedewed when it is cold, it is very difficult to start the discharge immediately after the power supply. In this embodiment, this problem has been solved by heating the dielectric member by a heating element.

Figure 8:
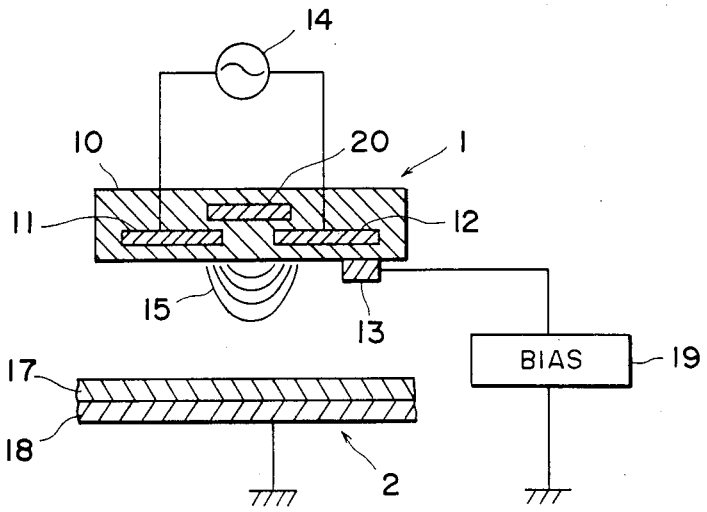
FIGS. 8, 9, 10 and 11 are sectional views of first improved embodiments of the device according to the present invention.
Figure 9:
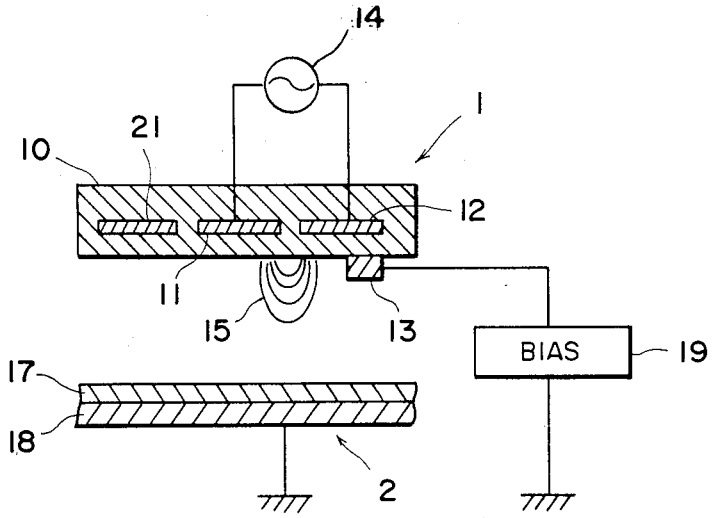

In FIGS. 8 and 9, the heating elements 20 and 21 are embedded in the dielectric member 10. The heating elements 20 and 21 are of a material which is different from that of the embedded electrodes 11 and 12, and may be manganin, C, W, NiCr, Ta, Ti, SiC having a high resistance, which may be evaporated and etched, for example. The resistance is dependent on the thermal capacity of the discharging device and the applied voltage, but may be between several ohms and several hundred ohms. To the heating elements, an alternating or DC voltage is applied which is independent of the alternating voltage applied between the embedded electrodes 11 and 12 and also independent of the bias voltage applied to the exposed electrode 13. By the application of this voltage, the heating elements 20 and 21 produce heat because the resistance is high. Since the entire surface of the heating element 20 is in contact with the dielectric member 10, the efficiency of the heat transfer is very high, and therefore, the dielectric member 10, and therefore, the discharging device 1 is quickly heated and dried. Thus, the discharging operation is started without difficulty.

In FIG. 9, the embedded electrodes 11 and 12 and the heating element 21 are on the same plane, so that they are formed simultaneously in the manufacturing process. As a result, the thickness of the device can be reduced. In order to further improve the easiness of the manufacturing, the same material is used for the heating element and for the embedded electrodes.

Figure 10:
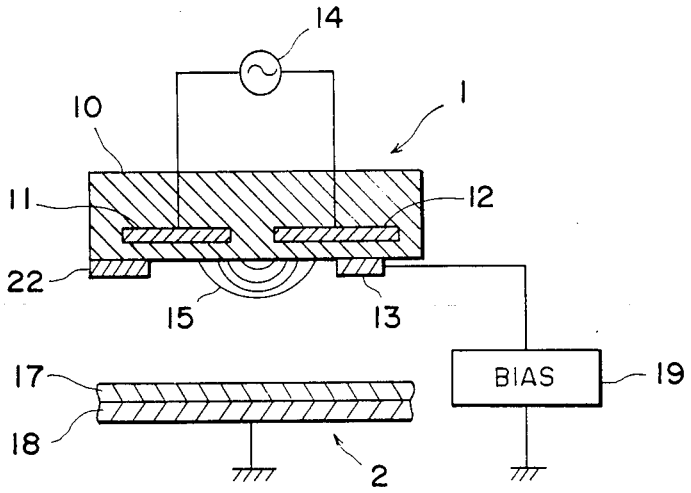
Figure 11:
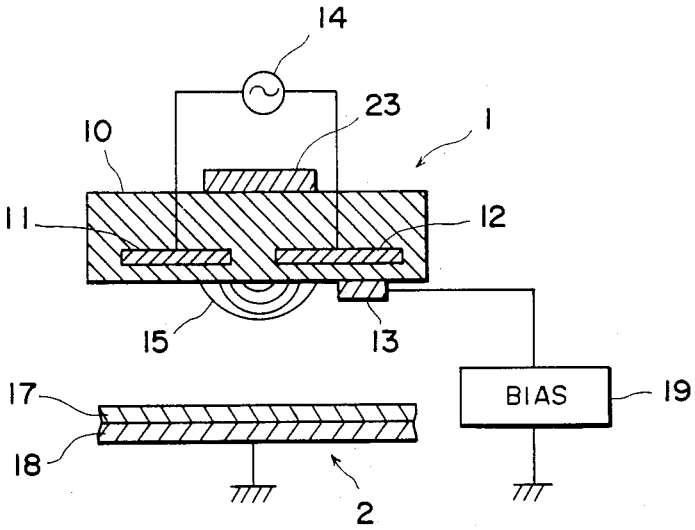

In FIGS. 10 and 11, the heating elements 22 and 23 are mounted to an outside surface of the dielectric member 10. The heating elements 22 and 23 are directly fixed to the dielectric member 10 without any material such as bonding agent or the like therebetween. In FIG. 10, it is fixed to the same side as the exposed electrode 13 is provided, while in FIG. 11, it is fixed to the opposite side. The heating elements 22 and 23 may be of manganin, C, W, NiCr, Ta, Ti, SiO or the like evaporated and etched. Or, an electrically conductive paint containing carbon or metal powder or the like is mixed in thermo setting resin material solved by a solvent may be used with a printing technique such as silk printing or the like. An AC or DC voltage is applied to the heating elements 22 and 23 as in the case of FIGS. 8 and 9 embodiments to produce the heating effect. In FIGS. 10 and 11 embodiments, the heating elements are directly contacted to the dielectric member surface without the bonding agent or the like therebetween, the heat transfer from the heating element is efficient.

According to the first improved embodiment, the heat is transferred efficiently and quickly to the dielectric member so that the temperature of the surface of the discharging device, particularly the temperature of the surface where the discharge occurs is instantaneously increased, so that the moisture on the surface of the dielectric member is quickly evaporated to enable the discharging operation.

In the foregoing embodiment, the description is concentrated on the moisture contained in the air and deposited onto the discharging device. However, another substance can be deposited. For example, if the substance which decreases the surface resistance of the dielectric member is deposited to the surface thereof where the alternating discharge occurs, for example, a production or productions of the discharge such as ammonia and nitric acid are deposited, the surface resistance of the surface of the dielectric member is slightly decreased. In the area where the surface resistance decreases, the alternating discharge becomes remarkably unstable, resulting in non-uniform discharge. Even in that case, the heating of the dielectric member by the heater is effective to stabilize the discharging action from the initial stage.

Now, a second improved embodiment will be described, wherein the discharging device is provided with the heating element, and wherein a temperature detecting sensor is provided to detect the temperature of or adjacent the dielectric member with means for controlling the heat produced by said heating element in accordance with the result of the detection.

Figure 12:
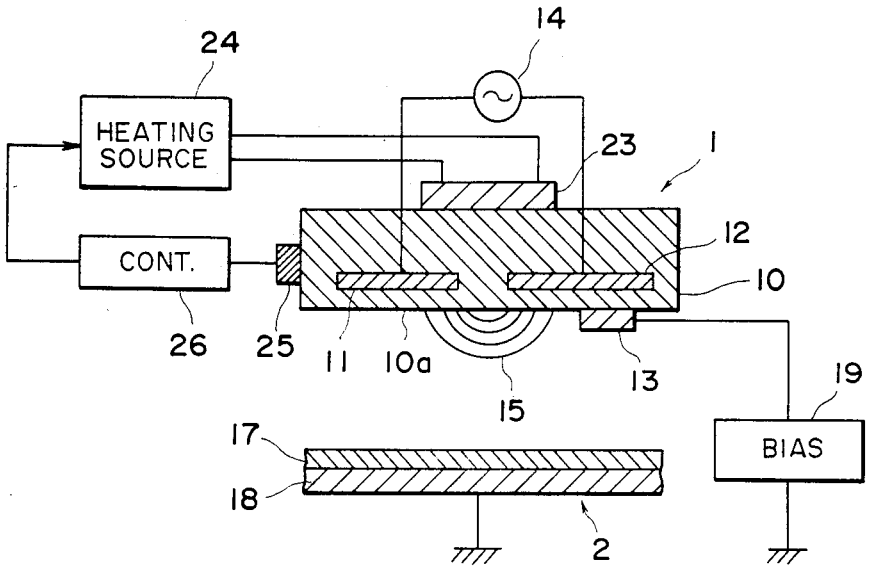
FIG. 12 is a sectional view of a second improved embodiment of the present invention.

The sensor and the control means will be described in an example of application to FIG. 11 embodiment. As shown in FIG. 12, the dielectric member 10 is provided with a temperature detecting element (a temperature sensor) 25 at the position shown in this Figure. On the other hand, the heating element 23 is supplied with power from the power source 24 for heater. The temperature detecting element 25 produces an output, which is transmitted to a control device 26. The control device 26 controls the power supply to the heating element 23 in accordance with the output of the temperature detecting element 25, so as to control the amount of heat produced by the heating element 23 which is a heating resistance.

The operation of the temperature detection and the heat control will be described. The heating element 23 heats the dielectric member 10 so that the temperature adjacent the discharging surface 10*a* reaches to such a temperature as to provide stable and uniform discharge. At this time, the temperature of the dielectric member 10 or the temperature adjacent the discharge surface 10*a* of the dielectric member 10, is detected by the temperature detecting element 25. If it detects the temperature which provides the stable and uniform discharge, the control device 26 produces a signal to stop the power supply to the heating element from the power source 24, or the current to the heater is controlled so that the temperature of the discharging surface or the temperature adjacent to it is maintained at the proper temperature. The control circuit may be of a known type.

Figure 13:
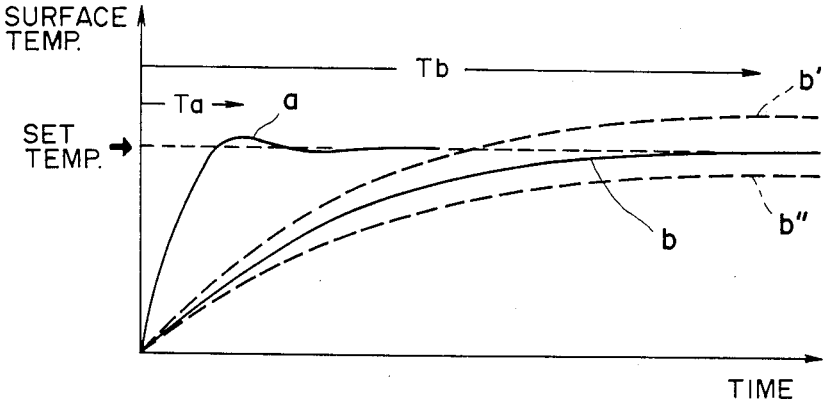
FIG. 13 is a graph showing a change of a surface temperature of a dielectric member when a heat control is employed and when it is not employed.

FIG. 13 is a graph showing the change in the temperature of the dielectric member surface from the start of heating to the set temperature for the stable discharge in the discharge device having the temperature detecting element 25 and the control device 26 and in the device without it. The curve b represents the case of the discharging device without the heat control, and it exhibit that a period Tb is required until the stable set temperature is reached (stabilized state in the surface temperature). If the ambient temperature is higher or lower, the temperature at the time of Tb is significantly offset from the set temperature, as indicated by the broken curves p′ and b″. Thus, without the control circuit, the heating element 23 is supplied with a constant current providing a constant quantity of heat, and therefore, a longer period of time is required until the stable state is reached, and in addition, the surface temperature is deviated from the set temperature if the ambient condition changes or due to the unavoidable variation of the heating elements. For this reason, it is not possible to provide the stable discharge states under all ambient conditions. With the discharging device shown in FIG. 12, the surface temperature of the dielectric member 10 is actually detected, and the quantity of heat produced by the heating element 23 is controlled by the control device 26 in response to the detection. Therefore, independently of the change in the ambient conditions and the unavoidable variation of the heating elements, it is possible to maintain the surface temperature at the set temperature which is desirable to stabilize the discharge. Also, since the quantity of heat produced can be controlled, it is possible that the electric current is selectively supplied or stopped, or controlled so as to provide a larger current (larger quantity of heat) at the initial stage of the heating and so as to control the current (the quantity of heat) after the set temperature is detected to maintain the set temperature. Therefore, as shown in FIG. 13 by reference , the shorter period Ta is sufficient to reach the set temperature. In this manner, the warming or waiting time required after the power supply is rendered on as in the case of the discharging device used with a copying machine or an electrostatic printer or the like, can be reduced, and therefore, the time required until the image forming operation is enabled, can be reduced.

The heating element 23 shown in FIG. 12 is the resistor heater utilizing the heat production due to the resistance loss, but another heating element is usable, such as a dielectric member utilizing a dielectric loss.

The position of the heating member is not limited to that shown in FIG. 12, but it may be those shown in FIGS. 8, 9 and 10. In any case, by locating the heating element close to the discharge region under the condition that it does not influence the discharge between the embedded electrodes 11 and 12, the surface temperature of the discharge region can be quickly increased. Particularly, as shown in FIGS. 8 and 9, it is preferable that the heating element is embedded in the dielectric member 10, since then, the heating element is protected by the dielectric member, so that the possible deterioration of the heating element due to the moisture or the discharge productions does not occur, whereby the durability and the reliability of the heating element is remarkably increased.

Figure 14:
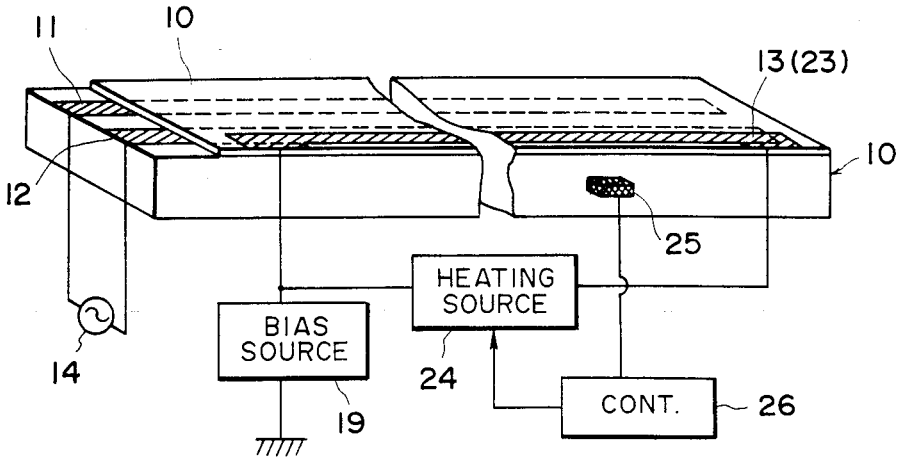
FIG. 14 is a perspective view of a modification of the second improved embodiment of the present invention.

FIG. 14 shows the discharging device wherein one of the electrodes functions also as a heating element. In the embodiment shown, the exposed electrode 13 is produced from a resistor, and the heat produced by the current through the resistor is used. As an alternative, one or more of the embedded electrodes are utilized also as the heating element. It should be noted that in the case of FIG. 14, the heating element can be placed most closely to the discharge region, and therefore, the necessary portion of the dielectric member can be quickly heated so that small consumption of electric power is sufficient. Therefore, this arrangement is most efficient from this standpoint.

The position of the temperature detecting element 25 is not limited to that shown in FIG. 12, but it may be disposed at a such a position as the temperature at least at the discharge region is correctly detected. Also, the temperature detecting element 25 may be of contact or non-contact type.

As described in the foregoing, according to the second improved embodiment of the present invention, the stable and uniform discharge can be started quickly and efficiently under wide ambient conditions. When the heating element is always supplied with the electric power, the discharging device which is capable of discharging by a small current, and therefore, with smaller power consumption, has to consume larger power. However, according to this embodiment, the current supply to the heater is properly controlled in accordance with the output of the temperature detecting element, so that the power consumption can be reduced.

A further improved embodiment of the present invention will be described. When the member is to be charged using the above described discharging device, the ambient conditions around the discharge region can not be neglected in order to obtain a uniform discharge. Third, fourth, fifth and sixth improved embodiment which are going to be described are capable of providing a constant amount of charging to the member under any conditions, that is, without being influenced by the change in the ambient conditions.

Figure 15:
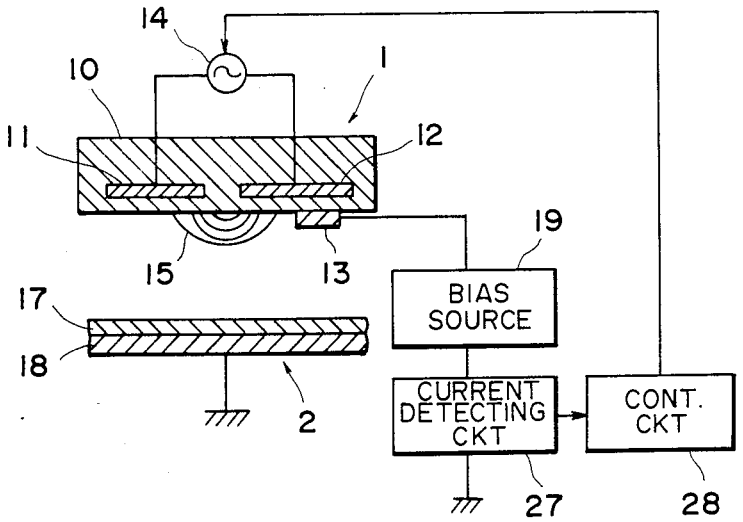
FIG. 15 is a sectional view of the device according to a third improved embodiment of the present invention.

FIG. 15 illustrates a third improved embodiment of the present invention, wherein the voltage level of the alternating voltage applied between the embedded electrodes 11 and 12 is controlled to provide the constant charging current. That is, when the ions of the desired property are moved to the member 2 to be charged by the application of the bias voltage, the charging current is detected by a current detecting circuit 27, in response to which a constant current control circuit 28 controls the voltage level provided by the alternating voltage source 14. By changing the alternating voltage level, the amount of discharge between the embedded electrodes 11 and 12 can be changed. Therefore, it is possible to control the alternating voltage level so as to maintain the charging current to the member to be charged at a predetermined level. Then, even if the ambient moisture or the temperature adjacent to the discharge region changes, that is, if a chane occurs in any factor which can influence the ion production amount, the amount of produced ions does not change, whereby the variation of the charging current can be removed.

Figure 16:
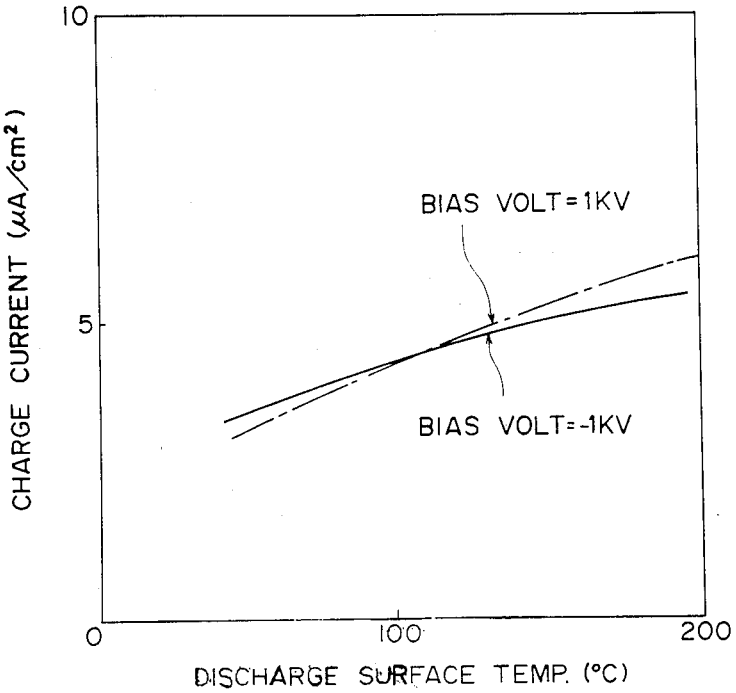
FIG. 16 is a graph showing a relation between a temperature of the discharging surface and the charging current in FIG. 15, when a constant current control is not employed.

FIG. 16 shows the variation in the charging current resulting from the variation of the temperature of the discharge surface when the charging current is not stabilized. The dielectric member 10 of the charging device 1 was of $SiO_2$ having the thickness of 10 microns, and the charging device 1 and the discharge region 15 were heated by an unshown heating element from the backside of the dielectric member 10. The alternating voltage used was 2 KV (peak-to-peak) having the frequency of 30 KHz. The bias voltage applied was ±1 KV. The distance between the exposed electrode 13 and the member 2 was set to be 1 mm. The charging current to a unit area (1 $cm^2$) of the member 2 was measured. As will be understood from this Figure, when the temperature is increased from 50°–200° C., the charging current increases to approximately 1.5–2.0 times. This significant increase of the charging current resulting from the increase of the discharge surface temperature is peculiar to the charging device of this type.

Thus, it has been found that the charging current significantly varies, when the discharge action is influenced by the ambient conditions such as moisture or the like (not heated), when a heater is used to stabilize the discharge or when the temperature is increased for the purpose of reducing production of ozone.

Therefore, without the charging current control of FIG. 15, the charging device is used in an electrophotographic copying machine or in an electrostatic recording machine, the charging current is significantly unstable.

Figure 17:
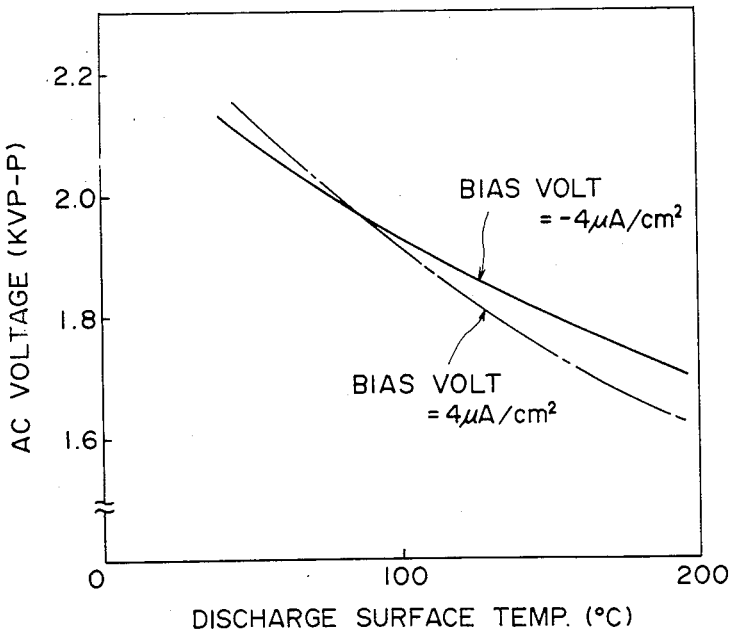
FIG. 17 is a graph showing a temperature of the discharging surface and the alternating voltage in the device of FIG. 15 when the charging current is constant.

FIG. 17 shows the relation between the alternating voltage and the discharge surface temperature according to this embodiment wherein the charging current is controlled. As will be understood, when the charging current is set ±4 micro ampere/$cm^2$, the change of the alternating voltage responsive to the temperature change varies very widely, that is, from approx. 2.1 KVpp at 50° C.–1.7 KVpp at 200° C. Therefore, to accomplish the constant current, the alternating voltage is required to be controlled in this wide range. Thus, it is understood that the discharging device of this type is sensitive to the temperature change which is not a problem in the conventional corona discharging device, since it leads to the change in the charging current, and that some means for providing the constant current is important in this discharging device.

Figure 18:
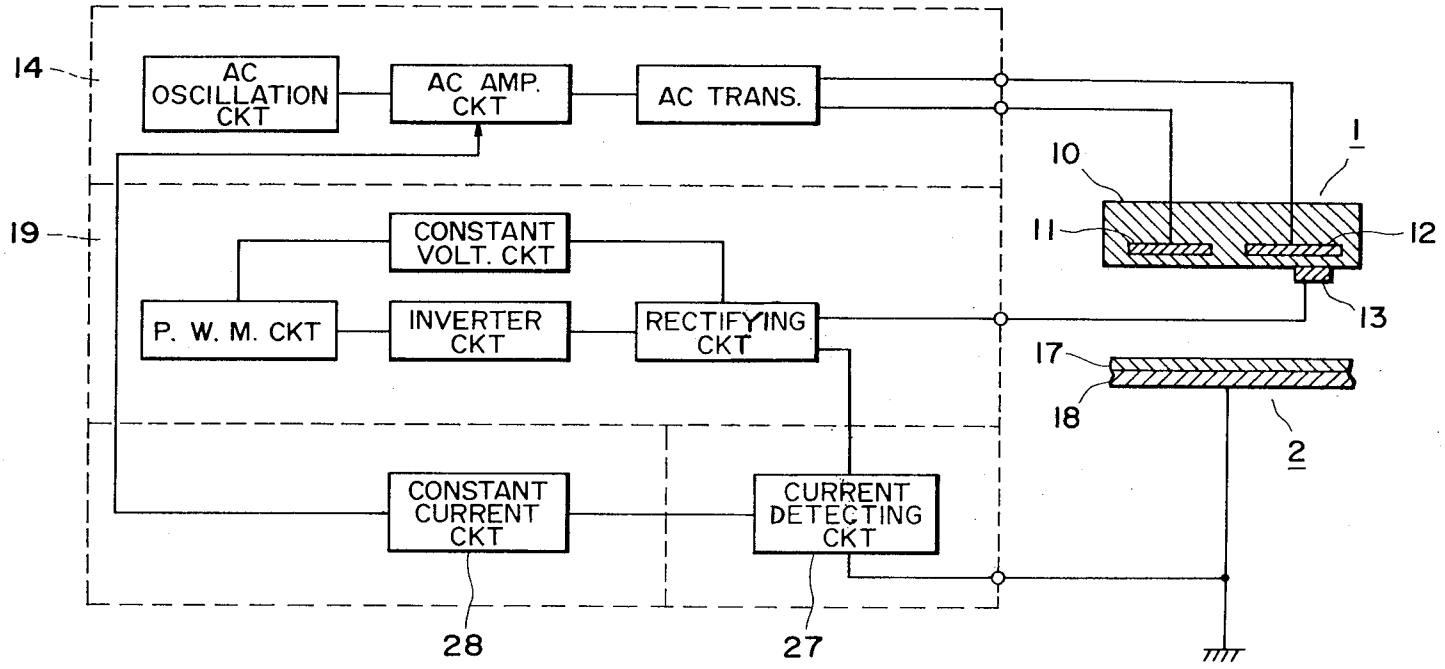
FIG. 18 is a block diagram illustrating a control for constant current in the device of FIG. 15.

FIG. 18 is a block diagram illustrating the alternating voltage source, the bias voltage source, the detecting circuit and the control circuit used with the charging device of FIG. 15. In response to the charging current detected by the current detecting circuit 27, the rate of amplification of an AC amplifier circuit in the alternating voltage source 14 is controlled by the control circuit 28, so that the output voltage of the alternating voltage source 14 is controlled so as to provide a predetermined constant charging current.

The means for making the charging current constant, is not limited to this example, but fandamentally, the charging device may be equipped with any means for detecting the charging current to the member to be charged and for controlling, in response to the detection, the alternating voltage to make the charging current constant independently of the discharge conditions. The constant current control is rather peculiar to the charging device of this type, wherein the quantity of produced ions is controlled under a constant external electric field by the bias voltage so as to provide the constant charging current, and therefore, it is fandamentally different from the constant current control method in a conventional corona charging device, wherein the corona discharging voltage is controlled.

In FIG. 18, a constant voltage control circuit is used in the bias voltage source 19 to make the bias voltage constant, but this is not always necessary.

Figure 19:
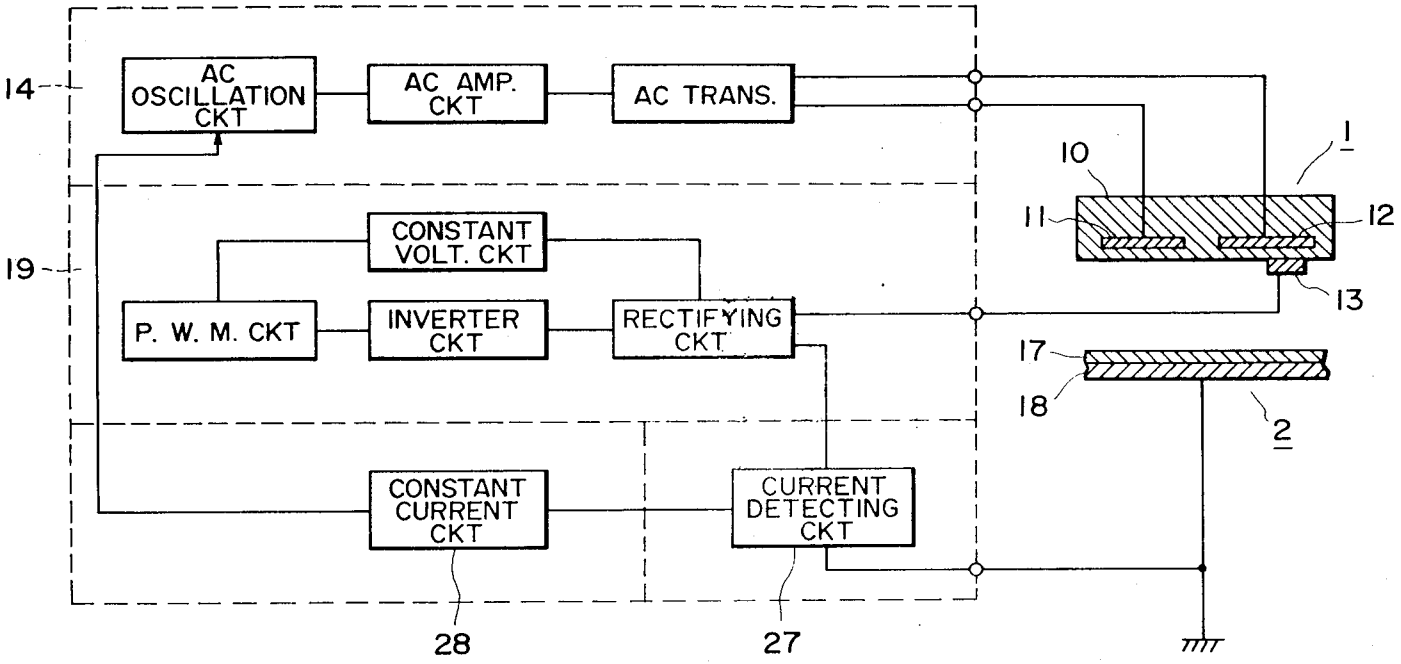
FIG. 19 is a block diagram illustrating a constant current control of a fourth improved embodiment of the present invention.

FIG. 19 illustrates a fourth improved embodiment of the present invention, wherein the frequency of the alternating voltage applied between the embedded electrodes 11 and 12 is controlled to provide the constant charging current. That is, when the ions of the desired property are moved to the member 2 to be charged by the application of the bias voltage, the charging current is detected by a curren& detecting circuit 27, in response to which a constant current control circuit 28 controls the frequency provided by the alternating voltage source 14, more particularly the oscillating frequency of the AC oscillating circuit therein. By changing the alternating voltage level, the amount of discharge between the embedded electrodes 11 and 12 can be changed. Therefore, it is possible to control the alternating voltage level so as to maintain the charging current to the member to be charged at a predetermined level. Then, even if the ambient moisture or the temperature adjacent to the discharge region changes, that is, if a change occurs in any factor which can influence the ion production amount, the amount of produced ions does not change, whereby the variation of the charging current can be removed.

Figure 20:
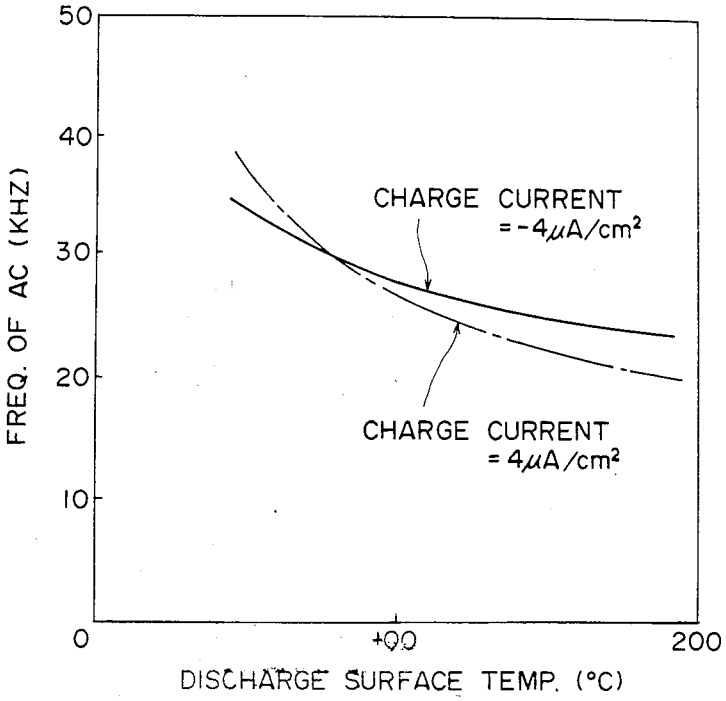
FIG. 20 is a graph showing the relation between a temperature of the discharging surface and the frequency of the alternating voltage in the device of FIG. 19 when the charging current is constant.

FIG. 20 shows the relation between the frequency of the alternating voltage and the discharge surface temperature according to this embodiment wherein the charging current is controlled. As will be understood, when the charging current is set ±4 micro ampere/$cm^2$, the change of the frequency of alternating voltage responsive to the temperature change varies very widely, that is, from approx. 35 KHz at 50° C. to 20–25 KHz at 200° C. Therefore, to accomplish the constant current, the frequency of the alternating voltage is required to be controlled in this wide range. Thus, it is understood that the discharging device of this type is sensitive to the temperature change which is not a problem in the conventional corona discharging device, since it leads to the change in the charging current, and that some means for providing the constant current is important in this discharging device.

The means for making the charging current constant, is not limited to this example, but fandamentally, the charging device may be equipped with any means for detecting the charging current to the member to be charged and for controlling, in response to the detection, the frequency of the alternating voltage to make the charging current constant independently of the discharge conditions. The constant current control is rather peculiar to the charging device of this type, similarly to the voltage control case, wherein the quantity of produced ions is controlled under a constant external electric field by the bias voltage so as to provide the constant charging current, and therefore, it is fandamentally different from the constant current control method in a conventional corona charging device, wherein the corona discharging voltage is controlled.

In FIG. 19, a constant voltage control circuit is used in the bias voltage source 19 to make the bias voltage constant, but this is not always necessary.

Figure 21:
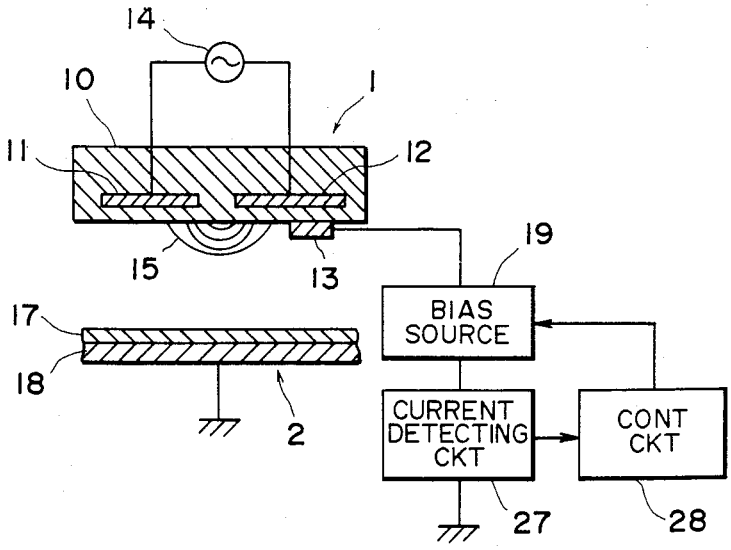
FIG. 21 is a sectional view of a device according to a fifth embodiment of the present invention.
Figure 22:
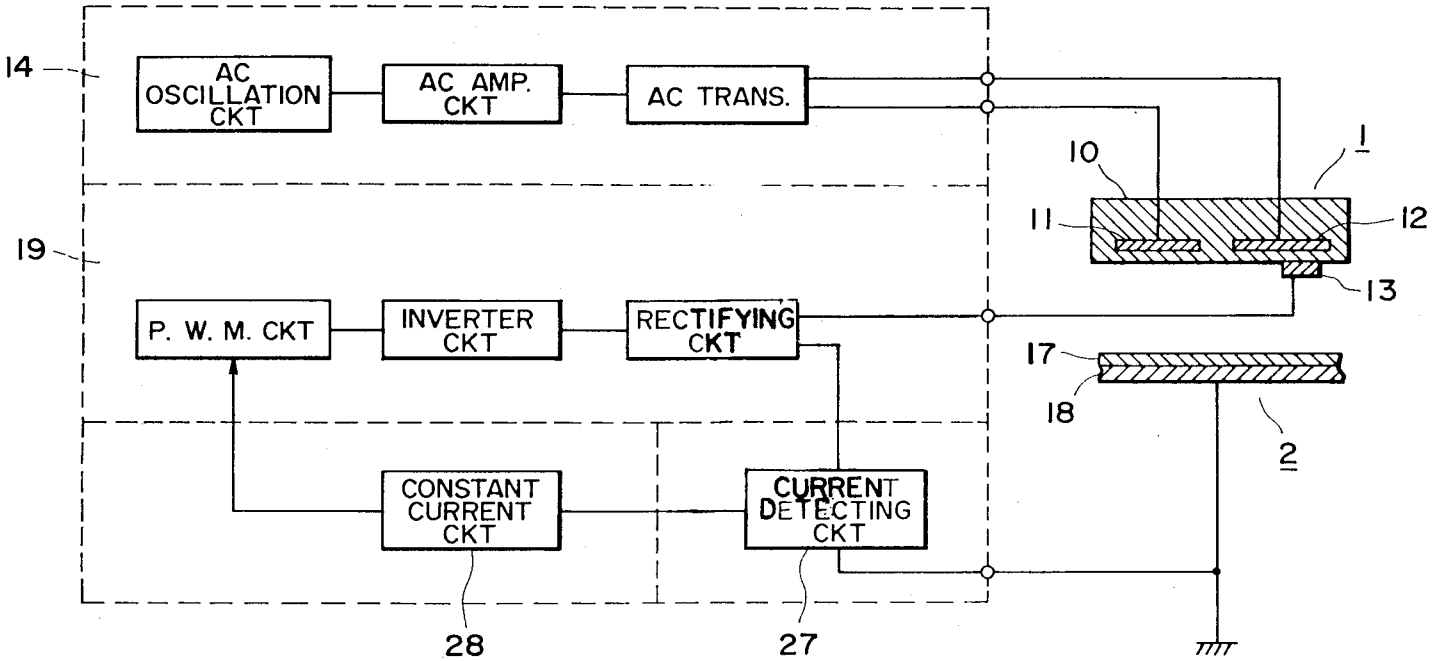
FIG. 22 is a block diagram illustrating a control for constant current for the device of FIG. 21.

FIG. 21 illustrates a fifth improved embodiment of the present invention, wherein the voltage level of the bias voltage applied between the exposed electrodes 13 and the member 2 is controlled to provide the constant charging current. That is, when the ions of the desired property are moved to the member 2 to be charged by the application of the bias voltage, the charging current is detected by a current detecting circuit 27, in response to which a constant current control circuit 28 controls the voltage level provided by the bias voltage source 19, more particularly, the P.W.M. circuit (pulse width control circuit) therein as shown in FIG. 22. Therefore, it is possible to control the bias voltage level so as to maintain the charging current to the member to be charged at a predetermined level. Then, even if the ambient moisture or the temperature adjacent to the discharge region changes, that is, if a change occurs in any factor which can influence the ion production amount, the amount of produced ions does not change, whereby the variation of the charging current can be removed.

Figure 23:
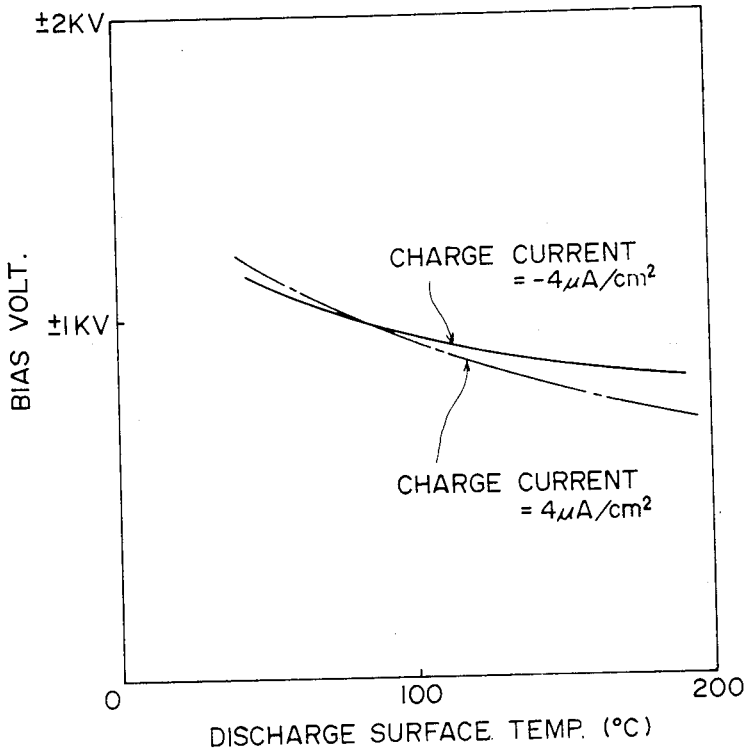
FIG. 23 is a graph showing the relation between a temperature of the discharging surface and the bias voltage in the device of FIG. 21 when the charging current is constant.

FIG. 23 shows the relation between the bias voltage and the discharge surface temperature according to this embodiment wherein the charging current is controlled. As will be understood, when the charging current is set $\pm 4$ micro ampere/cm$^2$, the change of the alternating voltage responsive to the temperature change varies very widely, that is, from approx. $\pm 1$ KV at 50° C. to $\pm 700$–800 V at 200° C. Therefore, to accomplish the constant current, the bias voltage is required to be controlled in this wide range. Thus, it is understood that the discharging device of this type is sensitive to the temperature change which is not a problem in the conventional corona discharging device, since it leads to the change in the charging current, and that some means for providing the constant current is important in this discharging device.

The means for making the charging current constant, is not limited to this example, but fundamentally, the charging device may be equipped with any means for detecting the charging current to the member to be charged and for controlling, in response to the detection, the alternating voltage to make the charging current constant independently of the discharge conditions. The constant current control is rather peculiar to the charging device of this type, similarly to the voltage or frequency control case, wherein from the quantity of produced ions desired quantity is extracted by the bias voltage so as to provide the constant charging current, and therefore, it is fundamentally different from the constant current control method in a conventional corona charging device, wherein the corona discharging voltage is controlled.

In the fourth or fifth improved embodiments, the description has been omitted as to the variation in the charging current when the constant current control is not employed. However, the similar state results when the constant current control is not used in any of those embodiments.

Figure 24:
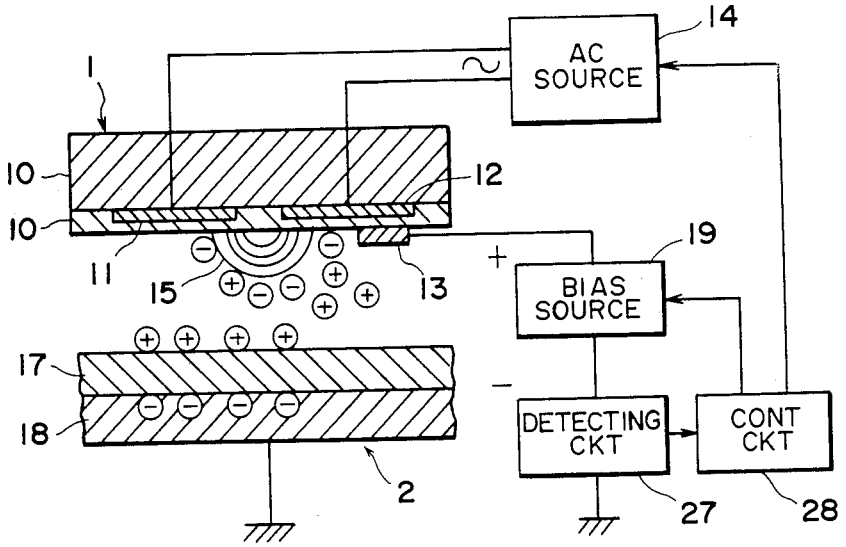
FIG. 24 is a sectional view of a device according to a sixth improved embodiment of the present invention.

FIG. 24 illustrates a sixth improved embodiment which is an extension of the fifth embodiment. In the sixth embodiment, the bias voltage applied by the bias voltage source 19 is controlled within a predetermined range in response to the charging current detected by the detecting circuit 27 to provide the constant charging current, and wherein when the control is necessary beyond the range, the voltage level or the frequency of the alternating voltage supplied by the alternating voltage source 14 between the embedded electrodes 11 and 12 is controlled to provide the constant charging current.

In the device shown in FIG. 24, the bias voltage is applied to the exposed voltage 13 so as to extract the positive ions. The charging current is detected by the current detecting circuit 27, and in response to the detected charging current, the bias voltage by the bias voltage source 19 is controlled by the control circuit 28, so that the external electric field is changed to maintain the charging current at a predetermined constant level.

In this embodiment, there is provided an upper limit to the controllable range of the bias voltage. When the predetermined charging current is not reached even if the bias voltage is increased up to this upper limit by the control circuit 28, a further control is performed by controlling the voltage level by the alternating voltage source 14 to change the AC electric field between the embedded electrodes 11 and 12, thus making the charging current reach the predetermined level without further changing the external electric field (the bias voltage). More detailed explanation will be made.

Figure 25:
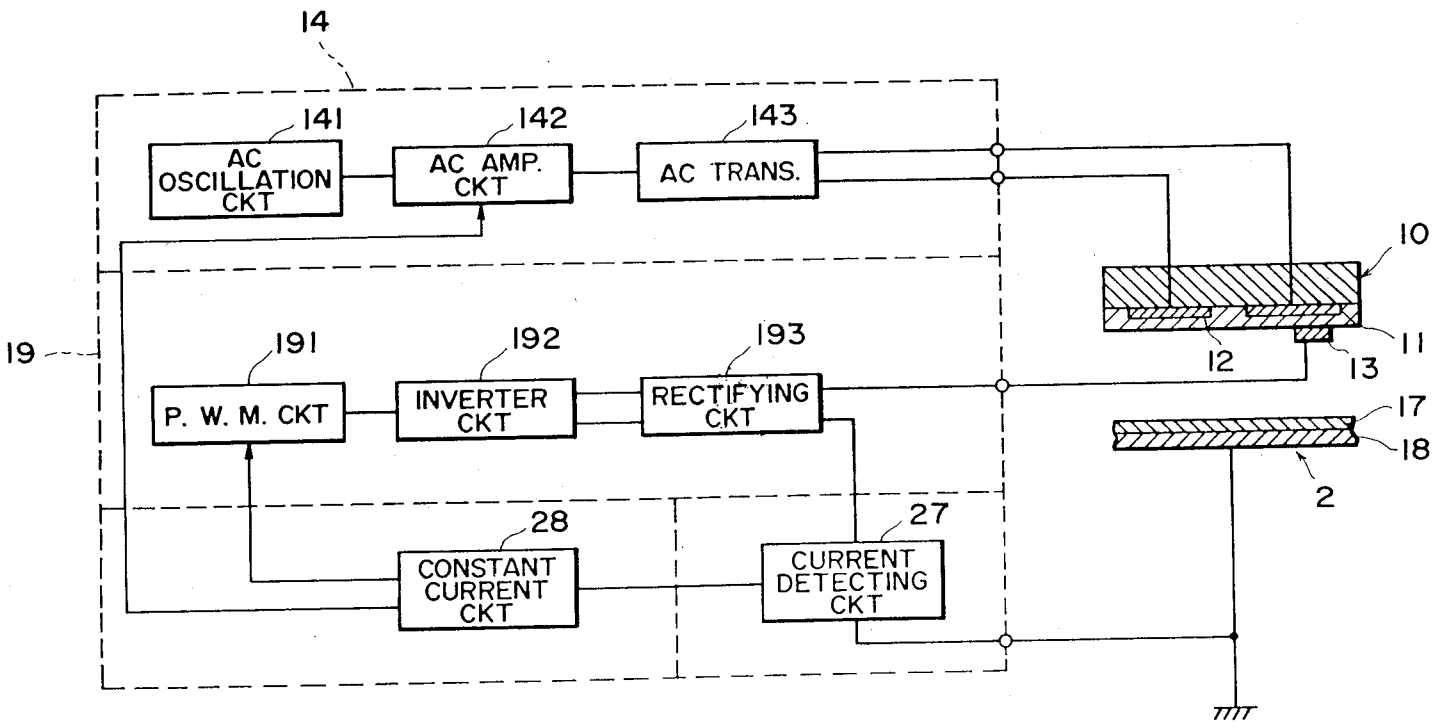
FIG. 25 is a block diagram illustrating a control for the constant current in the device of FIG. 24.

FIG. 25 is a block diagram of the device used with the FIG. 24 device, which contains the alternating voltage source 14, the bias voltage source 19, the detecting circuit 27 and the control circuit 28. The bias voltage source 19 includes P.W.M. circuit (pulse width control circuit) 191 to which the output of the constant current control circuit 28 is supplied, an inverter circuit 192 and a rectifying circuit 193. The alternating voltage source 14 includes an AC oscillating circuit 141, an AC amplifier circuit 142 controlled by the constant current control circuit 28 and an AC transformer 143. This is the same as in the devices of FIGS. 18, 19 and 22.

In operation, in response to the charging current detected by the current detecting circuit 27, the control circuit 28 controls the P.W.M. circuit 191 in the bias voltage source 19 to make it control the pulse width so as to control the output voltage of the bias voltage source 19 so as to provide the constant charging current.

If a situation occurs wherein the bias voltage is raised up to a predetermined upper limit, but the predetermined charging current is still not provided, the control circuit 28 then controls the rate of amplification in the AC amplifier circuit 142 in the alternating voltage source 14 to control the output voltage of the alternating voltage source 14 to provide the predetermined level of the charging current.

In this manner, the constant and predetermined charging current is provided.

As a result, when the discharge action changes due to the ambient moisture variation or the temperature variation adjacent the exposed electrode, that is, if the quantity of ion production adjacent the exposed electrode 13 varies, the variation in the charging current can be removed by the combieed control of the external electric field by changing the bias voltage and the control of the AC electric field in the AC discharge region 15 by changing the alternating voltage.

Figure 26:
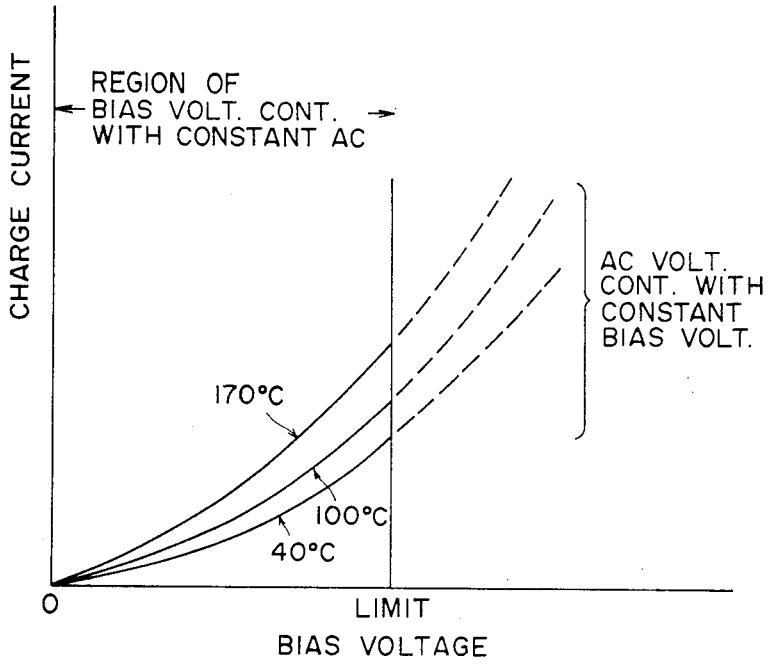
FIG. 26 shows characteristics of the constant current control in the device of FIG. 24.

Referring to FIG. 26, the constant current control of this embodiment will be further described.

As will be understood from FIG. 26, when a certain level off the bias voltage is applied, the charging current varies upon variation of the temperature around the discharging device. The variation of the charging current is detected, and the bias voltage is controlled so as to maintain the charging current at a predetermined level. If, however, the situation occurs wherein the charging current does not reach the predetermined even if the bias voltage is raised up to the upper limit shown in this Figure, then the alternating voltage is controlled to change the discharge at the discharge region 15 so as to increase the ions produced adjacent the exposed electrode to compensate the charging current.

The control of this embodiment is particularly advantageous, when the charging current is remarkably reduced for some reasons, for example, because of low resistance substance being deposited onto the dielectric member surface, thus narrowing the discharge area 15 remarkably. If the control is made only by the bias voltage control, the bias voltage will become, in such a situation, so high that electric discharge occurs between the exposed electrode and the member to be charged. By this embodiment, this can be avoided, and in addition, the charging current can be made stabilized since, the alternating voltage is further controlled.

In FIG. 26, as an example, the control against the variation in the temperature adjacent the discharging device. But this embodiment is not limited to the temperature, but can meet the influence of the ambient moisture, contamination of the discharging device, the variation in the charging current resulting from the property change in the member to be charged or any other factors, and can stabilize the charging.

The detailed structure of control are not limited to those described above in this embodiment. As an alternative, in place of controlling the AC voltage, an AC oscillating circuit 141 may be controlled so that the frequency thereof is changed, with the same advantageous effects. In the frequency control of the alternating voltage means the number of discharging action in the discharge region 15 per unit time is controlled. The charging current may be stabilized by changing the discharging action in this way.

In any event, the constant current control of this embodiment, similarly to the above described constant current control methods, is peculiar to the discharging device of this type, and is fandamentally different from the corona discharging voltage control in the conventional corona discharging devices.

In the descriptions of the third, fourth, fifth and sixth improved embodiments, the discharging device of FIG. 1 is taken as a representative but it is understood that the above described control of the alternating voltage, the frequency of the alternating voltage or the bias voltage for the purpose of the constant charging current is applicable to the discharging devices shown in FIGS. 3, 4, 6 and 7. Also, the description has been made with respect to the case where the member 2 is electrically charged, but it is understood that the same applies to the case where the member 2 is electrically discharged.

Next, the description will be made with respect to a modification of the structure of the dielectric member 10 in which the electrodes 11 and 12 are embedded. This modified embodiment is advantageous in that the durability, particularly the durability of the dielectric member is enhanced.

In this embodiment, the dielectric member 10 has a structure which is fandamentally similar to that of FIG. 1, but has a multi-layered structure.

Figure 27:
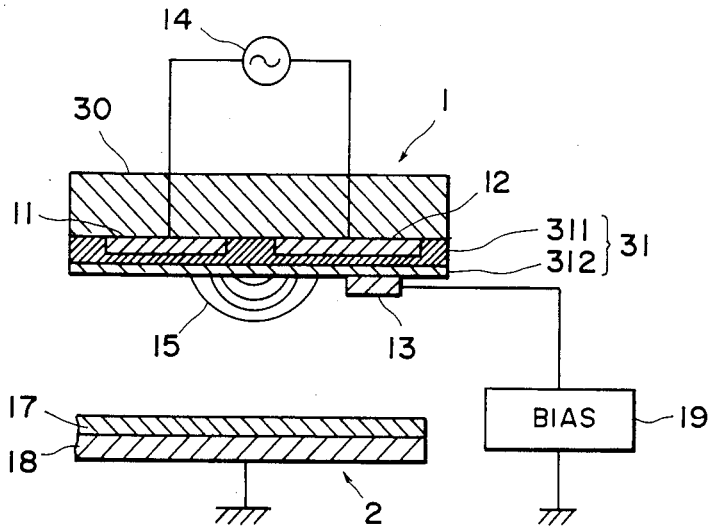
FIGS. 27, 28 and 29 are sectional views of various modifications of the dielectric member used with the present invention.

Referring to FIG. 27, the discharging device 1 includes a first dielectric member 30, on the surface of which there are at least two electrodes, i.e., a first electrode 11 and a second electrode 12 connected to an AC voltage source 14. The first and second electrodes 11 and 12 are covered by a second dielectric member 31 so as to constitute embedded electrodes in the dielectric member. On the surface of the second dielectric member 31, there is an exposed electrode 13 as a third electrode connected to a DC bias voltage source 19. The feature of this embodiment is in that the second dielectric member 31 is formed by two different layers of inorganic dielectric films.

In consideration of the easy manufacturing and the durability of the surface to the discharge, it is preferable that the inner layer is of a material which is easy for film formation, while the outside layer is of a material higher durable to the discharge. The inorganic dielectric materials have a tendency that the materials which are easily formed into a film has the low durability to discharge, while the materials which is not easy to form into a film has the high durability to discharge, and therefore, the above described preferable selection is possible.

The detailed description will be made as to the structure and materials of this embodiment.

In FIG. 27, the material of the first dielectric member 30 which is a supporting dielectric member is not limited to particular materials, but may be any solid dielectric material, such as a glass substrate, a ceramic substrate and resin material substrate or the like. As for the first electrode 11, the second electrode 12 and the third electrode 13, those described together with FIG. 1 are usable.

The second dielectric film 31 covering the first and second electrodes 11 and 12 has a thickness not less than 1 micron and not more than 500 microns, preferably not less than 3 microns and not more than 200 microns of an inorganic dielectric material having a high resistance to the discharge, such as glass, ceramic, an oxide ($SiO_2$, MgO, $Al_2O_3$, $Ta_2O_5$) (silicon nitride, aluminum nitride and amorphous silicon which are formed by evaporation, sputter filming method, CVD method or the like).

The inside layer 311 is made of the material among the above materials that is highest dielectric strength and is of good property of contact to the supporting substrate 30, and further that is relatively easily formed into film. The thickness thereof is selected to provide the sufficient dielectric strength. The outside layer 312 is made of the material among the above described material that is most durable to the discharge and that has a smooth surface with high surface resistance. Of those materials, the durability to discharge are in the following order:

$Al_2O_3$, MgO, $SiO_2$, glass

The order of the easy film formation is the opposite.

In operation, an alternating voltage is applied between the first and second electrode 11 and 12 by the alternating voltage source 14, and the alternating discharge occurs in the discharge region 15 adjacent to the surface of the second dielectric member 31. The strength of the electric field in the discharge region 15 is stronger at the central portion, and it becomes weaker toward the outside. The surface at which the alternating discharge occurs is the surface of the outside layer 312 having the high durability to the discharge, and the inside layer 31 provides sufficient durability to dielectric strength, and therefore, the deterioration of the dielectric member by the discharge does not proceed, whereby the stabilized AC discharge continues for a long period of time.

The discharging device of this embodiment is compared with a discharging device having a single-layered dielectric member.

As for the single layered dielectric member of an inorganic material, the second dielectric member 31 was formed by $SiO_2$ having 10 microns thickness by spattering, and continuous discharging operation was performed with an alternating voltage of sine wave having 1.7 KVpp and 35 KHz. After 150–200 hours operation, the dielectric film was etched by the discharge plasma and finally, the insulation brake down occurred.

As for the device of the present invention, the second dielectric member 31 was made of $SiO_2$ film having 9 microns thickness, and $Al_2O_3$ film was formed thereon with the thickness of 1 micron. The similar continuous discharging operation was performed. The stabilized discharging action continued for 500–600 hours.

As will be understood, according to this embodiment of the present invention, the durability is remarkably increased by forming a very thin layer of inorganic dielectric film having a high durability to discharge and having a property of difficult film formation, on an inorganic dielectric film having a property of easy film formation. Thus, the stabilized and uniform discharging or charging operation is possible for a long period of time.

A further embodiment will be described which is featured by the second dielectric member.

Figure 28:
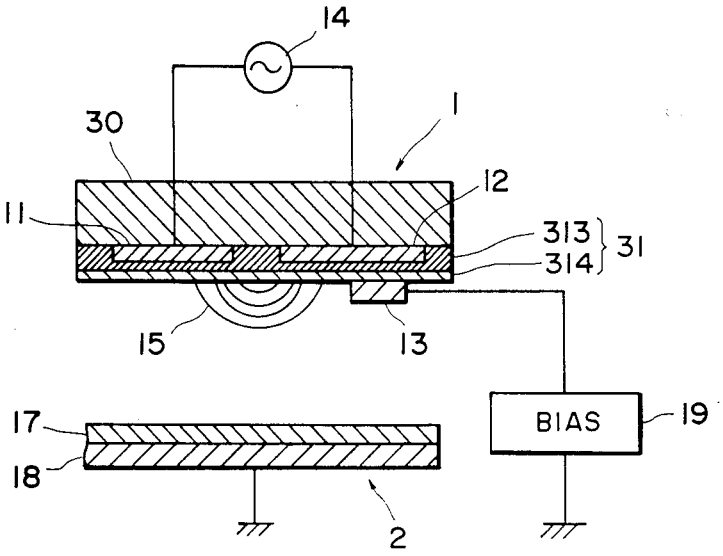

Referring to FIG. 28, the second dielectric member 31 includes an inside layer of organic dielectric film 313 and an outside layer of inorganic dielectric film 314. As discussed hereinbefore, the durability is very low if only the organic dielectric film only is used as the dielectric film. However, by forming the inside layer by organic dielectric film 31 having the thickness to provide sufficient durability to the insulation brake down and by forming an outside layer on the outside surface of the organic dielectric film 31 by an inorganic dielectric film 32 having a high durability to discharge with a required minimum thickness, the durability is remarkably increased, which has not been possible when only the organic dielectric film only is used.

The second dielectric film 31 covering the first and second electrodes 11 and 12 has a thickness not less than 1 micron and not more than 500 microns, preferably not less than 3 microns and not more than 200 microns of an inorganic dielectric material having a high resistance to the discharge, such as glass, ceramic, an oxide ($SiO_2$, MgO, $Al_2O_3$, $Ta_2O_5$) (silicon nitride, aluminum nitride and amorphous silicon which are formed by evaporation, sputter filming method, CVD method or the like).

The inside dielectric layer film 313 which covers the first and second electrodes 11 and 12 and which provides dielectric strength has a thickness not less than 1 micron and not more than 500 microns, preferably not less than 3 microns and not more than 200 microns of organic dielectric material such as polyimide, polyamide, epoxy resin, Teflon (trade name) and silicone resin, which is formed into a film by a dipping method, spin coating method or evaporation method or the like. The inorganic dielectric film 314, that is, the outside layer which provides the durability to discharge has a minimum required thickness for the purpose of protection from the discharge plasma etching, more particularly 0.1 micron–5 microns of glass, ceramic, $SiO_2$, MgO, $Al_2O_3$, silicon nitride or aluminum nitride which is formed into a film of that thickness by evaporation, sputtering, CVD method, dipping method or the like. The first, second and third electrode and the first dielectric member may be the same as those described in conjunction with FIG. 27.

In operation, an alternating voltage is applied between the first and second electrode 11 and 12 by the alternating voltage source 14, and the alternating discharge occurs in the discharge region 15 adjacent to the surface of the dielectric member 31. The strength of the electric field in the discharge region 15 is stronger at the central portion, and it becomes weaker toward the outside. The surface at which the alternating discharge occurs is the surface of the outside inorganic layer 312 having the high durability to the discharge, and the inside layer 31 provides sufficient durability to dielectric strength, and therefore, the deterioration of the dielectric member by the discharge does not proceed, whereby the stabilized AC discharge continues for a long period of time.

The discharging device of this embodiment is compared with a discharging device having a second dielectric member of organic material.

As for the single layered dielectric member of an organic material, the second dielectric member 31 was formed by polyimide resin having 20 microns thickness by dipping, and continuous discharging operation was performed with an alternating voltage of sine wave having 2 KVpp and 30 KHz. After several—several tens hours operation, the dielectric film was etched by the discharge plasma and finally, the insulation brake down occurred.

As an example of this embodiment, the organic dielectric film was made of polyimide resin having the thickness of 17 microns, and $SiO_2$ film having a thickness of 3 microns as the inorganic dielectric film 314 was sputtered thereon. The similar continuous discharging operation was possible for 70–100 hours with stability.

Thus, according to this embodiment, a very small thickness of inorganic dielectric member which is difficult to form into a film is applied on the organic dielectric film, by which the durability is significantly improved. In place of vacuum method for forming the $SiO_2$ film, it is possible to form the film by coating method, and in this method, the discharging device can be produced quickly and at low cost.

Thus, the stabilized and uniform discharging or charging operation is possible for a long period of time.

In addition, the organic dielectric member is easy to form into a film, and the inorganic dielectric member may be of very small thickness, and therefore, the manufacturing is easy.

A further embodiment will be described which is featured by the second dielectric member, again.

Figure 29:
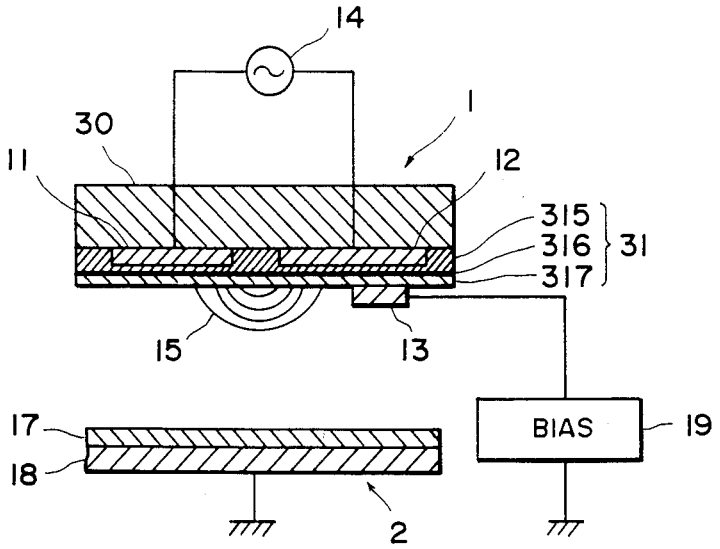

Referring to FIG. 29, the second dielectric member 31 includes an inside layer 315, an intermediate layer 316 and an outside layer 317 which are all of inorganic dielectric materials. The inside layer 315 is of a material which is easily formed into a film, the intermediate layer 316 is of a material exhibiting high durability to the discharge, and the outside layer 317 is of a material having a high resistance.

The inorganic dielectric materials have a tendency that the durability to discharge is low if it is easy to form into a film, while the durability to the discharge is high if it is difficult to form into a film. In view of this tendency, the inside layer 315 has a sufficient thickness to provide the satisfactory durability to the discharge, while the intermediate layer 316 may have a relatively small thickness to provide the satisfactory durability to the discharge. Also, the high resistance outside layer 317 may be thicker than the inside layer 315.

The dielectric film 31 covering the first and second electrodes 11 and 12 has a thickness not less than 1 micron and not more than 500 microns, preferably not less than 3 microns and not more than 200 microns of an inorganic dielectric material having a high resistance to the discharge, such as glass, ceramic, an oxide ($SiO_2$, MgO, $Al_2O_3$, $Ta_2O_5$) (silicon nitride, aluminum nitride and amorphous silicon which are formed by evaporation, sputter filming method, CVD method or the like).

The dielectric member includes three layers.

The inside layer 315 is made of the material among the above materials that is of good property of contact to the supporting substrate 30, and further that is relatively easily formed into film. The thickness thereof is selected to provide the sufficient dielectric strength. The intermediate layer 315 of a material which exhibits significantly high resistance to the discharge, with minimum thickness. The outside layer 317 is made of the material among the above described material that is most durable to the discharge and that has a smooth surface with high surface resistance. Of those materials, the durability to discharge are in the following order: $Al_2O_3$, MgO, $SiO_2$, glass Thus, the contradictory properties are shown between the easy film formation property and the durability to discharge, but as to the resistance, there is no such tendency, and $SiO_2$ and silicon nitride exhibit a high resistance. Therefore, as for the outside layer 317, a material which simply shows a high resistance may be selected among the inorganic dielectric member. As for the first, second and third electrodes and the first dielectric member, those described in conjunction with FIG. 27 are usable.

In the device constructed in the above described manner, an alternating voltage is applied between the first and second electrodes 11 and 12 by the alternating voltage source 14, by which the alternating discharge occurs in the discharge region 15 adjacent the surface of the dielectric member 31. The strength of the electric field in the discharge region 15 is strong at the central position and decreases gradually toward outside. Since, the inside layer 315 provides sufficient dielectric strength, and since the intermediate layer 316 provide the high durability to discharge, the durability of the device is remarkably increased. With respect to the outside layer 317, those materials among the above mentioned that have a relatively low surface resistance result in unstable alternating discharge occurring adjacent the surface of the dielectric member, and therefore, uniform discharging can not be maintained. This fact has been found by the inventors. On the basis of this finding, it is preferable in order to stabilize the discharge that the surface resistance is not less than $10^{11}$ ohm, more preferably not less than $10^{12}$ ohm. However, some material exhibits a large variation of the surface resistance depending on various conditions of film formation, when $Al_2O_3$, for example, is sputtered. In view of this, it is preferable to select $SiO_2$ or silicon nitride as the material for the outside layer, which provides a stable high resistance. Both of them exhibits stably the high resistance of approximately $10^{14}$ ohm.

The discharging device of this embodiment is compared with a discharging device having a single-layered dielectric member.

As for the single layered dielectric member of an inorganic material, the second dielectric member 31 was formed by $SiO_2$ (which is relatively easy to form into a film) having 10 microns thickness by spattering, and continuous discharging operation was performed with an alternating voltage of sine wave having 1.7 KVpp and 35 KHz. After 150–200 hours operation, the dielectric film was etched by the discharge plasma and finally, the insulation brake down occurred.

As for the device of the present invention, the second dielectric member 31 was made of $SiO_2$ film having 7 microns thickness as the inside layer 315, $Al_2O_3$ film was formed thereon with the thickness of 1 micron as the intermediate layer 316 and $SiO_2$ film of 2 microns was sputtered as the outside layer. The similar continuous discharging operation was performed. The stabilized discharging action continued for 500–600 hours.

As will be understood, according to this embodiment of the present invention, the durability is remarkably increased by forming the inorganic second dielectric member as three layers. Thus, the stabilized and uniform discharging or charging operation is possible for a long period of time.

In addition, the relatively thick inside layer is easy to form into a film, and the intermediate and outside layers may be thin, so that the manufacture is easy.

In addition, the relatively thick inside layer is easily formed into a film, while the intermediate and outside layers may be satisfactorily formed into a thin film, and therefore, the dielectric member is easily manufactured.

As described in the foregoing in conjunction with FIGS. 27, 28 and 29, the dielectric member is formed in a multi-layered structure, the durability of the dielectric member is made longer, so that the entire performance of the device is improved.

In the above described embodiments, the structure of FIG. 1 is taken as a representative, but those embodiments are applicable to the second dielectric member of the discharging devices of FIGS. 6 and 7. Also, it is applicable to the discharging device of FIG. 4, more particularly, the second dielectric member of the above described embodiments is applicable to the part of the dielectric member between the embedded electrode 42 and the exposed electrode 43.

As described in the foregoing, according to the present invention, a discharging device which is small in size and which is not easily contaminated, with a high durability, can be provided. Further, it can be operated stably and uniformly to effect the electric charging or discharging without being influenced by the change in the ambient conditions.

As an example of the temperature control described hereinbefore, the temperature around the discharge surface is preferably maintained at 70° C. under the condition that the ambient temperature and humidity is 30° C. and 90%, respectively. If the ambient temperature is lower, the controlled temperature is also decreased, but not below 40° C.

While the invention has been described with reference to the structures disclosed herein, it is not confined to the details set forth and this application is intended to cover such modifications or changes as may come within the purposes of the improvements or the scope of the following claims.

What is claimed is:

1. A device for electrically discharging or charging a member to be discharged or charged, comprising:

a dielectric member;

first and second electrodes embedded in said dielectric member, said first and second electrodes being supplied with an alternating voltage therebetween to cause discharge adjacent a part of a surface of said dielectric member, a third electrode disposed to or adjacent a part of the surface of said dielectric member at such a position as when said discharge starts to occur with increase of the alternating voltage applied between said first and second electrodes, no discharge occurs between said first electrode and said third electrode or between said second electrode and said third electrode;

means for applying an alternating voltage between said first electrode and said second electrode;

means for applying a bias voltage between said third electrode and said member to be discharged or charged to discharge or charge it.

2. A device according to claim 1, further comprising means for heating said dielectric member.

3. A device according to claim 2, wherein said heating means includes a heating element directly contacted to a surface or the surface of said dielectric member.

4. A device according to claim 2, wherein said heating means includes a heating element embedded in said dielectric member.

5. A device according to claim 2, further comprising means for detecting a temperature of the dielectric member or a temperature in the neighborhood thereof, and control means for controlling said heating means in accordance with detection by said detecting means.

6. A device according to claim 1, further comprising current detecting means for detecting a charging current to the member to be discharged or charged while it is being discharged or charged and means for controlling the alternating voltage supplied by said alternating voltage applying means in accordance with detection by said current detecting means to provide a predetermined charging current.

7. A device according to claim 1, further comprising current detecting means for detecting a charging current to the member to be discharged or charged while it is being discharged or charged and means for controlling the frequency of the alternating voltage supplied by said alternating voltage applying means in accordance with detection by said current detecting means to provide a predetermined charging current.

8. A device according to claim 1, further comprising current detecting means for detecting a charging current to the member to be discharged or charged while it is being discharged or charged and means for controlling the bias voltage supplied by said alternating voltage applying means in accordance with detection by said current detecting means to provide a predetermined charging current.

9. A device according to claim 8, wherein said control means controls said bias voltage within a predetermined range, and wherein when the bias voltage to be set is outside said predetermined range, the level of the alternating voltage or the frequency thereof by said alternating voltage applying means is controlled to provide the predetermined charging current.

10. A device according to claim 1, wherein said dielectric member is elongated, and said first, second and third electrodes extend along a length of said dielectric member.

11. A device according to claim 10, wherein said first and second electrodes are parallel with the surface of said dielectric member to be opposed to the member to be charged or discharged, and they are distant from the surface by the same distance.

12. A device according to claim 10, wherein said first and second electrodes are parallel with the surface of the dielectric member to be opposed to the member to be discharged or charged, and they are distant from the surface by different distances.

13. A device according to claim 11 or 12, wherein said dielectric member has a flat surface to be opposed to the member to be discharged or charged.

14. A device according to claim 13, wherein said dielectric member has a substantially rectangular cross section.

15. A device according to claim 11 or 12, wherein said first and second electrodes extend substantially parallel to each other.

16. A device according to claim 2, wherein at least one of said first, second and third electrodes, also functions as a heating element of said heating means.

17. A device according to claim 1, wherein said dielectric member is formed by laminating plural dielectric layers.

18. A device according to claim 17, wherein a part of the dielectric member which covers said first and second electrodes and disposed between said third electrodes and said first and second electrodes includes at least two different inorganic dielectric layers.

19. A device according to claim 18, wherein said inorganic dielectric layers include an inside layer near said first and second electrodes, which are made of material which is relatively easily formed into a film, and a layer on the inside layer of a material higher durable to discharge.

20. A device according to claim 19, wherein said inorganic dielectric layer further includes an additional layer on said layer which is higher durable to discharge, said additional layer is of a material having a high resistance.

21. A device according to claim 17, wherein a part of said dielectric member which covers said first and second electrodes which is disposed between said third electrode and said first and second electrode includes a layer of organic dielectric material near said first and second electrodes and an inorganic dielectric layer on the organic dielectric layer.

22. A discharging device, comprising:

a dielectric member having a discharging surface;

a plurality of electrodes embedded in said dielectric member and extending with a predetermined clearance therebetween and parallel to the discharging surface of the dielectric member;

a bias electrode extending parallel to said discharging surface outside a portion of the discharging surface opposed to the clearance between the embedded electrodes.

* * * * *

UNITED STATES PATENT AND TRADEMARK OFFICE

CERTIFICATE OF CORRECTION

PATENT NO. : 4,783,716

DATED : November 8, 1988

INVENTOR(S) : Nagase, et al.

It is certified that error appears in the above-identified patent and that said Letters Patent is hereby corrected as shown below:

Title page:

AT [30] FOREIGN APPLICATION PRIORITY DATA

After "Nov.28, 1986 [JP] Japan ..... 61-283469" insert
--Dec. 24, 1986 [JP] Japan ..... 61-306341--
--Dec. 24, 1986 [JP] Japan ..... 61-306342--
--Dec. 24, 1986 [JP] Japan ..... 61-306343--
--Dec. 24, 1986 [JP] Japan ..... 61-306344--.

COLUMN 1

Line 13, "eletrophotographic" should read --electrophotographic--.
Line 31, "discharged." should read --charged.--.
Line 45, "is" should read --are--.
Line 60, "colloded" should read --corroded--.

COLUMN 2

Line 27, "collosion" should read --corrosion--.
Line 37, "collo-" should read --corro---.

COLUMN 4

Line 8, "is" should read --are--.
Line 33, "collosion" should read --corrosion--.
Line 64, "collosion" should read --corrosion--.

UNITED STATES PATENT AND TRADEMARK OFFICE

CERTIFICATE OF CORRECTION

PATENT NO. : 4,783,716

DATED : November 8, 1988

INVENTOR(S) : Nagase, et al.

It is certified that error appears in the above-identified patent and that said Letters Patent is hereby corrected as shown below:

COLUMN 5

Line 6, "embedded electrodes 11 and 13" should read --embedded electrodes 11 and 12--.
Line 31, "cases" should read --case--.

COLUMN 6

Line 40, "1- αKVpp," should read --1-4 KVpp,--.

COLUMN 7

Line 58, "caused" should read --is caused--.

COLUMN 8

Line 33, "is" should read --are--.
Line 38, ""cue"" should read --as a "cue"--.

COLUMN 9

Line 27, "&he" should read --the--.
Line 60, "&o" should read --to--.
Line 68, "collosion" should read --corrosion--.

UNITED STATES PATENT AND TRADEMARK OFFICE

CERTIFICATE OF CORRECTION

PATENT NO. : 4,783,716

DATED : November 8, 1988

INVENTOR(S) : Nagase, et al.

It is certified that error appears in the above-identified patent and that said Letters Patent is hereby corrected as shown below:

COLUMN 10

Line 34, "collosion" should read --corrosion--.

COLUMN 11

Line 46, "discharging device 1" should read --discharging device 31--.

COLUMN 12

Line 59, "exposed electrode 13" should read --exposed electrode 43--.

COLUMN 13

Line 10, "caused" should read --is caused--.
Line 38, "exposed electrode 13" should read --exposed electrode 43--.
Line 60, ""cue"" should read --as a "cue"--.

COLUMN 15

Line 12, "is" should read --are--.
Line 39, "collosion" should read --corrosion--.
Line 50, "are removed." should read --are not removed--.

UNITED STATES PATENT AND TRADEMARK OFFICE

CERTIFICATE OF CORRECTION

PATENT NO. : 4,783,716

DATED : November 8, 1988

INVENTOR(S) : Nagase, et al.

It is certified that error appears in the above-identified patent and that said Letters Patent is hereby corrected as shown below:

COLUMN 16

Line 28, "solved" should read --dissolved--.

COLUMN 17

Line 43, "broken curves p'" should read --broken curves b'--.

COLUMN 18

Line 1, "reference," should read --reference a,--.

COLUMN 19

Line 20, "chane" should read --change--.

COLUMN 20

Line 38, "curren&" should read --current--.

COLUMN 22

Line 26, "exposed voltage 13" should read --exposed electrode 13--.

UNITED STATES PATENT AND TRADEMARK OFFICE

CERTIFICATE OF CORRECTION

PATENT NO. : 4,783,716

DATED : November 8, 1988

INVENTOR(S) : Nagase, et al.

It is certified that error appears in the above-identified patent and that said Letters Patent is hereby corrected as shown below:

COLUMN 23

Line 10, "combieed" should read --combined--.
Line 17, "off" should read --of--.
Line 23, "predetermined" should read --predetermined level--.

COLUMN 24

Line 67, "material" should read --materials--.

COLUMN 25

Line 15, "inside layer 31" should read --inside layer 311--.
Line 26, "spattering" should read --sputtering--.
Line 30, "brake down" should read --breakdown--.
Line 56, "brake down" should read --breakdown--.

COLUMN 26

Line 34, "inside layer 31" should read --inside layer 311--.
Line 49, "brake" should read --breakdown--.
Line 50, "down" should be deleted.

UNITED STATES PATENT AND TRADEMARK OFFICE

CERTIFICATE OF CORRECTION

PATENT NO. : 4,783,716

DATED : November 8, 1988

INVENTOR(S) : Nagase, et al.

It is certified that error appears in the above-identified patent and that said Letters Patent is hereby corrected as shown below:

COLUMN 27

Line 43, "material" (second occurrence) should read --materials--.

COLUMN 28

Line 24, "spattering" should read --sputtering--.
Line 29, "brake down" should read --breakdown--.
Line 35, "outside layer." should read --outside layer 317.--.

COLUMN 30

Line 64, "first and second electrode" should read --first and second electrodes--.

Signed and Sealed this

Third Day of April, 1990

*Attest:*

HARRY F. MANBECK, JR.

*Attesting Officer*

*Commissioner of Patents and Trademarks*